US010048607B2

(12) United States Patent
Ishikawa et al.

(10) Patent No.: US 10,048,607 B2
(45) Date of Patent: Aug. 14, 2018

(54) TONER HAVING TONER PARTICLES INCLUDING A COLORANT AND PARTICLES NOT INCLUDING A COLORANT

(71) Applicants: KABUSHIKI KAISHA TOSHIBA, Tokyo (JP); TOSHIBA TEC KABUSHIKI KAISHA, Tokyo (JP)

(72) Inventors: Junichi Ishikawa, Mishima Shizuoka (JP); Takashi Urabe, Sunto Shizuoka (JP); Taishi Takano, Sunto Shizuoka (JP); Satoshi Araki, Mishima Shizuoka (JP); Maiko Yoshida, Mishima Shizuoka (JP)

(73) Assignees: Kabushiki Kaisha Toshiba, Tokyo (JP); Toshiba TEC Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/648,142

(22) Filed: Jul. 12, 2017

(65) Prior Publication Data

US 2017/0307992 A1 Oct. 26, 2017

Related U.S. Application Data

(62) Division of application No. 14/811,166, filed on Jul. 28, 2015, now abandoned.

(30) Foreign Application Priority Data

Sep. 10, 2014 (JP) ..... 2014-184680

(51) Int. Cl.

| | |
|---|---|
| ***G03G 9/09*** | (2006.01) |
| ***G03G 9/087*** | (2006.01) |
| ***G03G 9/08*** | (2006.01) |

(52) U.S. Cl.

CPC ..... *G03G 9/0902* (2013.01); *G03G 9/0812* (2013.01); *G03G 9/0819* (2013.01);

(Continued)

(58) Field of Classification Search

CPC ..... G03G 9/0902

See application file for complete search history.

(56) References Cited

U.S. PATENT DOCUMENTS 8,722,291 B2 5/2014 Sugitate et al.
2002/0192585 A1* 12/2002 Brenner ..... G03G 9/0902 430/108.6

(Continued)

FOREIGN PATENT DOCUMENTS

JP 2013200522 A 10/2013

*Primary Examiner* — Hoa V Le

(74) *Attorney, Agent, or Firm* — Patterson & Sheridan, LLP

(57) ABSTRACT

A toner includes first toner particles and second toner particles. Each of the first toner particles includes a plate-like colorant particle covered with binder resin particles, and a volume average size of the plate-like colorant particle is equal to or greater than 6 μm. Each of the second toner particles includes at least one of a binder resin and a releasing agent and not including a colorant, an aspect ratio of the second toner particles is equal to or smaller than 3, and a content ratio of the releasing agents with respect to the second toner particles is equal to or greater than 4 wt % and equal to or smaller than 24 wt %. A content ratio of the second toner particles with respect to the first toner particles is greater than 1 wt % and equal to or smaller than 75 wt %.

20 Claims, 3 Drawing Sheets

(52) U.S. Cl.
CPC ..... *G03G 9/0825* (2013.01); *G03G 9/0827* (2013.01); *G03G 9/08782* (2013.01); *G03G 9/09* (2013.01); *G03G 9/0926* (2013.01)

(56) References Cited

U.S. PATENT DOCUMENTS

| | | | | |
|---|---|---|---|---|
| 2010/0183968 | A1 | 7/2010 | Sugawara et al. | |
| 2010/0209835 | A1 | 8/2010 | Takahashi et al. | |
| 2010/0216066 | A1 | 8/2010 | Kadokura et al. | |
| 2011/0129771 | A1 | 6/2011 | Fujita et al. | |
| 2013/0252155 | A1* | 9/2013 | Sugitate ..... | G03G 9/0819 430/105 |
| 2015/0111140 | A1* | 4/2015 | Noguchi ..... | G03G 9/08795 430/105 |
| 2015/0139682 | A1 | 5/2015 | Ota | |
| 2015/0248081 | A1 | 9/2015 | Kuribayashi et al. | |

* cited by examiner

TONER HAVING TONER PARTICLES INCLUDING A COLORANT AND PARTICLES NOT INCLUDING A COLORANT

CROSS-REFERENCE TO RELATED APPLICATION

This application is a division of U.S. patent application Ser. No. 14/811,166, filed on Jul. 28, 2015, which claims the benefit of priority from Japanese Patent Application No. 2014-184680, filed Sep. 10, 2014, the entire contents of which are incorporated herein by reference.

FIELD

Embodiments described herein relate generally to a toner, in particular, a toner having toner particles including a colorant and particles not including a colorant.

BACKGROUND

Toner of one type contains a bright (glittering) pigment which expresses metallic luster or pearl luster, as a colorant. The bright pigment, for example, includes mica covered with a metal oxide, an aluminum pigment, and the like. Such a bright pigment typically has a large particle size, e.g., a particle size of about 5 μm to 200 μm. Further, the bright pigment typically has a flat reflective surface by which light beams are reflected in several directions. As the particle size of the bright pigment becomes larger, the area of the reflective surfaces thereof becomes larger, and thus the metallic luster or the pearl luster is more strongly expressed. To the contrary, when the particle size of the bright pigment is small, the metallic luster or the pearl luster is little expressed.

When the particle size of the bright pigment included in a toner as a colorant is large, the bright pigment may not be sufficiently covered with a resin. If so, an image formed with the toner may not be firmly fixed to a sheet. On the other hand, when a thicker resin is formed so as to more completely cover the bright pigment, a particle size of the toner may become too large. Toner of such an excessively large particle size may cause an error in a developing process or a transfer process of the toner. Further, the bight pigment may not be properly aligned on the sheet to express the metallic luster or the pearl luster.

DETAILED DESCRIPTION

Figure 1:
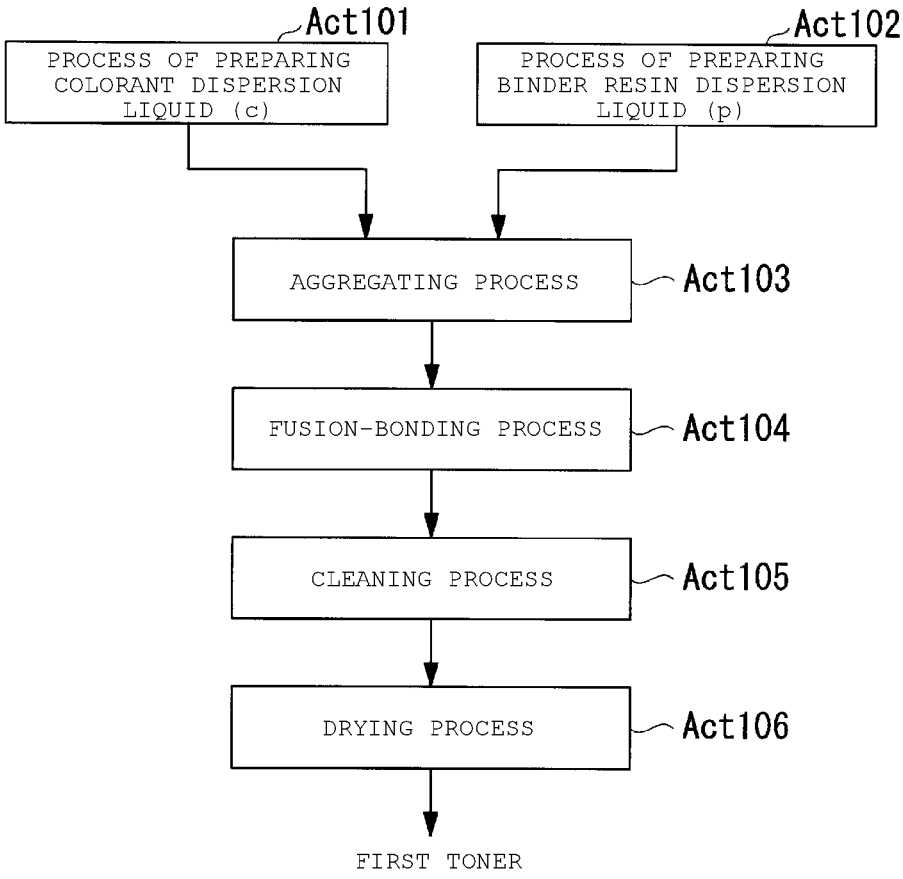
FIG. 1 is a flow chart illustrating a manufacturing method of a first toner.

An embodiment provides a toner which has preferable coloring properties and good fixability, an image forming apparatus, and an image forming method using the toner.

In general, according to an embodiment, a toner includes first toner particles and second toner particles. Each of the first toner particles includes a plate-like colorant particle covered with binder resin particles, and a volume average size of the plate-like colorant particle is equal to or greater than 6 μm. Each of the second toner particles includes at least one of a binder resin and a releasing agent and not including a colorant, an aspect ratio of the second toner particles is equal to or smaller than 3, and a content ratio of the releasing agents with respect to the second toner particles is equal to or greater than 4 wt % and equal to or smaller than 24 wt %. A content ratio of the second toner particles with respect to the first toner particles is greater than 1 wt % and equal to or smaller than 75 wt %.

Hereinafter, a toner composition according to an embodiment will be described with reference to the accompanying drawings.

The toner composition according to the embodiment contains a first toner and a second toner.

A toner according to the embodiment is a resin-containing fine powder having electrostatic properties. The resin-containing fine powder may or may not include a colorant.

Examples of the toner composition according to the present embodiment include a toner composition mixture which is a mixture of the first toner and the second toner which are toners stored in the same developing device.

Examples of the toner composition according to the present embodiment include a substance (in an image area) obtained by mixing the first toner and the second toner on a recording medium. The image area in which these two types of toners are mixed on the recording medium is formed by an image forming apparatus that includes a first developing device which stores the first toner and a second developing device which stores the second toner.

Hereinafter, a configuration of the first toner will be described.

The first toner contains a particle group (particle group (t1)) of particles, as a main component. Each of the particles is obtained by covering a plate-like colorant particle with binder resin particles.

In the first toner, plate-like colorant particles is included as a colorant. The plate-like colorant particle causes the toner to be easily oriented in parallel with the recording medium and causes coloring properties to be easily obtained when an image is formed.

The colorant particles have a volume average particle size of equal to or greater than 6 μm, and preferably 6 μm to 300 μm. When the colorant particles have a volume average particle size of equal to or greater than the lower limit value, the sufficient coloring properties are obtained when an image is formed. When the colorant particles have a volume average particle size of greater than 300 μm, control of developing, transferring, and the like in electrophotographic processing may be difficult.

An aspect ratio (long diameter/short diameter) of the plate-like colorant particle is preferably equal to or greater than 3, more preferably equal to or greater than 10, and further preferably from 20 to 40. When the aspect ratio of the colorant particle is equal to or greater than the preferable lower limit value, glittering properties of the colorant particle are enhanced. When the aspect ratio of the colorant particle is equal to or less than the further preferable upper limit value, the colorant particle can be sufficiently covered with the binder resin particles.

In the present disclosure, the volume average particle size of a particle group may be measured by a particle size distribution measuring apparatus.

The aspect ratio (long diameter/short diameter) of the particle is obtained as follows. The long diameter of the particle is measured by a particle size distribution measuring apparatus, and is the same as the volume average particle size of the particle group. The short diameter of the particle is an average value obtained by measuring short diameters on side surfaces of a plurality of particles based on an SEM image obtained by a scanning electron microscope (SEM), and averaging these measured short diameters.

Examples of a colorant, which constitutes the colorant particle, include carbon black, an organic or inorganic pigment, and the like.

Examples of the carbon black include acetylene black, furnace black, thermal black, channel black, ketjen black, and the like.

Examples of the organic or inorganic pigment include a yellow pigment, a magenta pigment, a cyan pigment, a glitter pigment, and the like.

Examples of the yellow pigment include C.I. Pigment Yellow 1, 2, 3, 4, 5, 6, 7, 10, 11, 12, 13, 14, 15, 16, 17, 23, 65, 73, 74, 81, 83, 93, 95, 97, 98, 109, 117, 120, 137, 138, 139, 147, 151, 154, 167, 173, 180, 181, 183, and 185; and C.I. Vat Yellow 1, 3, and 20. As the yellow pigment, only one type of yellow pigment may be used, or two or more types of yellow pigments may be used together.

Examples of the magenta pigment include C.I. Pigment Red 1, 2, 3, 4, 5, 6, 7, 8, 9, 10, 11, 12, 13, 14, 15, 16, 17, 18, 19, 21, 22, 23, 30, 31, 32, 37, 38, 39, 40, 41, 48, 49, 50, 51, 52, 53, 54, 55, 57, 58, 60, 63, 64, 68, 81, 83, 87, 88, 89, 90, 112, 114, 122, 123, 146, 150, 163, 184, 185, 202, 206, 207, 209, and 238; C.I. Pigment Violet 19; C.I. Vat Red 1, 2, 10, 13, 15, 23, 29, and 35. As the magenta pigment, only one type of magenta pigment may be used, or two or more types of magenta pigments may be used together.

Examples of the cyan pigment include C.I. Pigment Blue 2, 3, 15, 16, and 17; C.I. Vat Blue 6; and C.I. Acid Blue 45. As the cyan pigment, only one type of cyan pigment may be used, or two or more types of cyan pigments may be used together.

An example of the glitter pigment is not particularly limited as long as a pigment has the glittering properties. Examples of the glitter pigment include metal powder such as aluminum, brass, bronze, nickel, stainless steel, and zinc; a flaky inorganic crystal substrate which is covered with metal oxide; single crystal plate-like titanium oxide; basic carbonate; acid bismuth oxychloride; natural guanine; a flaky glass powder; and a flaky glass powder which is subjected to metal deposition.

Examples of the flaky inorganic crystal substrate include mica, barium sulfate, layered silicates, silicates of layered aluminum, and the like.

Examples of the metal oxide for covering the flaky inorganic crystal substrate include titanium oxide, iron oxide, and the like.

Among these substances, to have higher glittering properties, the flaky inorganic crystal substrate covered with the metal oxide, and the metal powder are preferable as the glitter pigment, and the flaky inorganic crystal substrate covered with the metal oxide is more preferable.

As the colorant, only one type of colorant may be used, or two or more types of colorants may be used together.

Among these types of colorant, to obtain the coloring properties, the organic or inorganic pigment is preferable, and the glitter pigment is more preferable among organic or inorganic pigments.

The content of the colorant in the first toner is not particularly limited. However, the content of the first toner is preferably in a range of, for example, 10 wt % to 65 wt % with respect to the total amount of the first toner, and more preferably in a range of 20 wt % to 50 wt %. If the content of the colorant is less than the preferable lower limit value, it is difficult to obtain metallic luster or pearl luster. If the colorant content exceeds the preferable upper limit value, fixability or fastness of an image is easily degraded.

Examples of the binder resin which is used in the first toner include a polyester resin, a polystyrene resin, and the like.

As the polyester resin, condensation polymer of polycarboxylic acid and polyalcohol is preferable, and condensation polymer of a dicarboxylic acid component and a diol component is more preferable.

Examples of the dicarboxylic acid component include aromatic dicarboxylic acid, aliphatic carboxylic acid, and the like. Examples of aromatic dicarboxylic acid include terephthalic acid, phthalic acid, isophthalic acid, and the like. Examples of aliphatic carboxylic acid include fumaric acid, maleic acid, succinic acid, adipic acid, sebacic acid, glutaric acid, pimelic acid, oxalic acid, malonic acid, citraconic acid, itaconic acid, and the like.

Examples of the diol component include aliphatic diol, alicyclic diol, aromatic diol, ethylene oxide adduct, propylene oxide adduct, and the like. Examples of aliphatic diol include ethylene glycol, propylene glycol, 1,4-butanediol, 1,3-butanediol, 1,5-pentanediol, 1,6-hexanediol, neo-pentyne glycol, trimethylene glycol, trimethylol propane, pentaerythritol, and the like. Examples of alicyclic diol include 1,4-cyclohexanediol, 1,4-cyclohexanedimethanol, and the like. Examples of aromatic diol include bisphenol A and the like. Examples of ethylene oxide adduct include ethylene oxide adduct of bisphenol A, and the like. Examples of propylene oxide adduct include propylene oxide adduct of bisphenol A, and the like.

As the polyester resin, cross-linked polyester resins may be used. The cross-linked polyester are synthesized using trivalent or more carboxylic acid or trihydric or higher polyhydric alcohol component, for example. Examples trivalent or more carboxylic acid include 1,2,4-benzenetricarboxylic acid (trimellitic acid) and the like. Examples of the trihydric or higher polyhydric alcohol component include glycerin and the like.

As the polyester resin, an amorphous polyester resin or a crystalline polyester resin may be used.

As the polystyrene resin, copolymer of an aromatic vinyl component and a (meth)acrylic acid ester component is preferable. The (meth)acrylic acid ester corresponds to at least one of acrylic acid ester and methacrylic acid ester.

Examples of the aromatic vinyl component include styrene, α-methylstyrene, o-methylstyrene, p-chlorostyrene, and the like. Examples of the (meth)acrylic acid ester component include ethyl acrylate, propyl acrylate, butyl acrylate, 2-ethylhexyl acrylate, butyl methacrylate, ethyl methacrylate, methyl methacrylate, and the like. Among these, butyl acrylate is generally used.

As a polymerization method of the aromatic vinyl component and the (meth)acrylic acid ester component, an emulsion polymerization method is generally used. The polystyrene resin is obtained by, for example, performing radical polymerization on monomers of components in an aqueous phase containing an emulsifier.

A weight-average molecular weight (Mw) of the binder resin is preferably in a range of 3000 to 70000. Mw of the binder resin is more preferably in a range of 5000 to 50000, and further preferably in a range of 10000 to 30000.

If Mw of the binder resin is less than the preferable lower limit value, heat resistant preservability of the toner may be likely to be degraded. As Mw of the binder resin becomes greater, a fixation temperature becomes higher. When Mw of the binder resin is equal to or less than the preferable upper limit value, an increase of a power consumption amount in fixing processing is easily suppressed.

In the present disclosure, the weight-average molecular weight (Mw) of the resin has a value obtained by performing polystyrene conversion using gel permeation chromatography.

As the binder resin, only one type of binder resin may be used, or two or more types of binder resins may be used together.

Among binder resins, the polyester resin is preferable from a viewpoint of a low glass transition temperature (Tg) and excellence in low-temperature fixability.

Among polyester resins, a substance having Tg of equal to or greater than 35° C. is preferable. A substance having Tg of 40° C. to 70° C. is more preferable, and a substance having Tg of 45° C. to 65° C. is further preferable. When Tg is equal to or greater than the preferable lower limit value, storage stability of the toner is improved more significantly. When Tg is equal to or less than the preferable upper limit value, the low-temperature fixability becomes better.

The glass transition temperature (Tg) of the resin is measured by a differential scanning calorimetry.

Among the polyester resins, a polyester resin having the acid number of 5 to 30 is preferable and a polyester resin having the acid number of 5 to 20 is more preferable.

The content of the binder resin in the first toner is appropriately set in accordance with the content of the colorant. The content of the binder resin is preferably in a range of, for example, 30 wt % to 85 wt % with respect to the total amount of the first toner, and more preferably in a range of 40 wt % to 70 wt %. If the binder resin content is less than the preferable lower limit value, it is difficult to ensure the fixability and the fastness of an image. If the binder resin content exceeds the preferable upper limit value, it is difficult to ensure the fixability and the glittering properties, and the toner scattering tends to occur.

The first toner may contain another component (optional component (1)) as necessary, other than the plate-like colorant particle and the binder resin. Examples of the optional component (1) include a releasing agent, a surfactant, a coagulant, an electrification control agent, a pH adjusting agent, an external additive, and the like.

The first toner may or may not contain the releasing agent.

When the first toner contains an appropriate amount of the releasing agent, offset performance is improved further. When a tandem-type image forming apparatus is used, and the first toner contains an appropriate amount of the releasing agent, the first toner is less likely to contaminate a fixing member regardless of a sequence of developing devices of different colors.

When the first toner does not contain the releasing agent, poor charging due to the releasing agent on a surface of the first toner is prevented. In addition, poor developing and the like occurring due to the releasing agent contaminating the developing device are prevented.

Examples of the releasing agent in the optional component (1) include an aliphatic hydrocarbon-based wax such as low molecular weight polyethylene, low molecular weight polypropylene, polyolefin copolymer, a polyolefin wax, a paraffin wax, and a Fischer Tropsch Wax, and a modified material of these materials; a botanical wax such as a candelilla wax, a carnauba wax, a vegetable wax, a jojoba wax, and a rice wax; an animal wax such as a beeswax, a lanoline, and a spermaceti wax; a mineral wax such as a montan wax, ozokerite, and ceresin; an ester wax which contains fatty acid ester as a main component, such as a palmitic acid ester wax, a montanoic acid ester wax, and a caster wax; fatty acid amide such as amide linoleate, amide oleate, and lauric acid amide; a functional synthetic wax; and silicone wax.

As the releasing agent, only one type of releasing agent may be used, or two or more types of releasing agents may be used together.

Among releasing agents, from a viewpoint of obtaining of an excellent effect in suppression of occurrence of offset, aliphatic hydrocarbon wax and the ester wax which contains fatty acid ester as a main component are preferable. Among these, a paraffin wax, and an ester wax which contains a palmitic acid ester as a main component are more preferable.

When the first toner contains the releasing agent, the releasing agent content in the first toner is preferably equal to or less than, for example, 20 wt % with respect to the total amount of the first toner, more preferably equal to or less than 15 wt %, and further preferably in a range of 2 wt % to 15 wt %.

When the releasing agent content is equal to or less than the preferable upper limit value, poor charging or poor developing of the toner is prevented further. When the releasing agent content is equal to or greater than the preferable lower limit value, occurrence of the offset is easily suppressed.

The surfactant is mainly used as a dispersant in the optional component (1) when toner particles are manufactured. Examples the surfactant include an anionic surfactant such as a sulfuric ester salt, sulfonate, a phosphoric ester salt, soap, and a carboxylic salt; a cationic surfactant such as an amine salt, and a quarternary ammonium salt; an amphotic surfactant such as betaine; a nonionic surfactant of polyethylene glycols, alkylphenols ethylene oxide adducts, and polyhydric alcohols; and a polymer type surfactant such as polycarboxylic acid.

Examples of the coagulant in the optional component (1) include a monovalent metal salt such as sodium chloride; a multivalent metal salt such as magnesium sulfate and aluminum sulfate; a non-metal salt such as ammonium chloride and ammonium sulfate; acid such as hydrochloric acid and nitric acid; and a strong cationic coagulant such as polyamine and polydiallyl dimethyl ammonium chloride (poly DADMAC). The surfactant is used as the coagulant.

Among these, from a viewpoint an aggregation accelerating effect, the non-metal salt is preferable, and more preferably, ammonium sulfate.

Examples of the electrification control agent in the optional component (1) include an azo compound containing metal, a salicylic acid derivative compound containing metal, polysaccharide compound containing metal, and the like.

Among azo compounds including metal, a complex or a complex salt of iron, cobalt, or chrome, or a mixture thereof is preferable.

Among salicylic acid derivative compounds including metal, a complex or a complex salt of zirconium, zinc, chrome, or boron, or a mixture thereof is preferable.

Among polysaccharide compounds containing metal, polysaccharide containing aluminum and/or magnesium is preferable.

Examples of the pH adjusting agent in the optional component (1) include a base such as sodium hydroxide, potassium hydroxide, and an amine compound; and acid such as hydrochloric acid, nitric acid, and sulfuric acid.

Examples of the amine compound include dimethylamine, trimethylamine, monoethylamine, diethylamine, triethylamine, propylamine, isopropylamine, dipropylamine, butylamine, isobutylamine, sec-butylamine, monoethanolamine, diethanolamine, triethanolamine, triisopropanolamine, isopropanolamine, dimethylethanolamine, diethylethanolamine, N-butyl diethanolamine, N, N-dimethyl-1,3-diaminopropane, N,N-diethyl-1,3-diaminopropane, and the like.

Examples of the external additive in the optional component (1) include silica particles, particles of inorganic oxide such as titanium oxide, particles obtained by performing surface processing on these particles with a hydrophobing agent, and the like. The external additive is added so as to apply liquidity to the toner or to adjust electrostatic properties, and the like.

A manufacturing method of the first toner will be described below with reference to the accompanying drawings.

The manufacturing method of the first toner is not particularly limited. However, as the manufacturing method of the first toner, a chemical method, which is less likely to crush plate-like colorant particles, is preferable in comparison to a pulverizing method, because the glittering properties are more likely to be obtained.

FIG. 1 is a flow chart illustrating the manufacturing method of the first toner.

An embodiment illustrated in FIG. 1 includes a process (Act101) of preparing a colorant dispersion liquid (c), a process (Act102) of preparing a binder resin dispersion liquid (p), an aggregating process (Act103), a fusion-bonding process (Act104), a cleaning process (Act105), and a drying process (Act106).

The process (Act101) of preparing the colorant dispersion liquid (c) will be described below.

The colorant dispersion liquid (c) is liquid in which plate-like colorant particles are dispersed.

The content of the colorant in the colorant dispersion liquid (c) is not particularly limited, but preferably in a range of 2 wt % to 15 wt % with respect to the total amount of the colorant dispersion liquid (c).

As a dispersion medium in the colorant dispersion liquid (c), for example, an aqueous medium is used. Examples of the aqueous medium include water, a solvent mixture of water and an organic solvent, and the like, and water is preferable among these media.

The colorant dispersion liquid (c) may contain a component (optional component (c)) other than the colorant and the dispersion medium. The optional component (c), for example, includes a surfactant, a coagulant, and the like. As the surfactant and the coagulant in the optional component (c), substances similar to the surfactant and the coagulant, which are described above as the optional component (1), are included.

The colorant dispersion liquid (c) is prepared by, for example, mixing the dispersion medium, the colorant particles, and the optional component (c) (as necessary) with each other.

The process (Act102) of preparing the binder resin dispersion liquid (p) will be described below.

The binder resin dispersion liquid (p) is a liquid in which binder resin particles are dispersed.

The binder resin content in the binder resin dispersion liquid (p) is appropriately set in accordance with the concentration of the colorant and the like, and is preferably in a range of, for example, 20 wt % to 40 wt % with respect to the total amount of the binder resin dispersion liquid (p).

As a dispersion medium in the binder resin dispersion liquid (p), for example, an aqueous medium is used. Examples of the aqueous medium include water, a solvent mixture of water and an organic solvent, and the like, and water is preferable among these media.

The binder resin dispersion liquid (p) may contain a component (optional component (p)) other than the binder resin and the dispersion medium. Examples of the optional component (p) include a surfactant, a pH adjusting agent, and the like. As the surfactant and the pH adjusting agent in the optional component (p), substances similar to the surfactant and the pH adjusting agent, which are described as the optional component (1), are included. pH of the binder resin dispersion liquid (p) is preferably adjusted to be in a range of substantially 9 to 13.

The binder resin dispersion liquid (p) is prepared by, for example, mixing the dispersion medium, the binder resin, and the optional component (p) (as necessary) with each other. When the binder resin dispersion liquid (p) is prepared, mechanical shearing power is applied to disperse substances in the liquid mixture, and thereby the binder resin is pulverized.

The shape of the binder resin particle is not particularly limited. Examples of the shape of the binder resin particle include a spherical shape, a cylindrical shape, a plate shape, and the like. Among these shapes, the spherical shape is preferable because aggregation with the colorant particle is more likely to occur.

The binder resin particles in the binder resin dispersion liquid (p) preferably has a volume average particle size of 0.03 μm to 0.40 μm, and more preferably, 0.05 μm to 0.30 μm. When the particle group of resin particles has a volume average particle size of equal to or greater than the preferable lower limit value, it is difficult to form an aggregate (homo-particle) of binder resin particles. When the particle group of binder resin particles has a volume average particle size of equal to or less than the upper limit value, a surface of the colorant particle is likely to be covered with the resin particle.

A ratio (colorant particle/binder resin particle) of the volume average particle size of the particle group of colorant particles and the volume average particle size of the particle group of binder resin particles is preferably in a range of 20 to 1200, and more preferably 25 to 1000. When the ratio (colorant particle/binder resin particle) of the volume average particle sizes is equal to or greater than the preferable lower limit value, the coloring properties are more likely to be obtained when an image is formed. When the ratio of the volume average particle sizes is equal to or less than the preferable upper limit value, improved fixability is obtained.

The aggregating process (Act103) will be described below.

In the aggregating process (Act103), for example, the binder resin dispersion liquid (p) is added to the colorant dispersion liquid (c). At this time, the plate-like colorant particle and the binder resin particles are aggregated. Thus, an aggregate dispersion liquid in which aggregates obtained by covering a surface of the colorant particle with the binder resin particles are dispersed is obtained.

When the binder resin dispersion liquid (p) is added to the colorant dispersion liquid (c), it is preferable that the binder resin dispersion liquid (p) is added little by little with taking the time, to the total amount of the colorant dispersion liquid (c). A predetermined amount of the binder resin dispersion liquid (p) may be continuously added or may be intermittently added. To more reliably and densely covering the surface of the colorant particle with the binder resin particles, it is preferable that the predetermined amount of the binder resin dispersion liquid (p) is continuously added to the colorant dispersion liquid (c). When the predetermined amount of the binder resin dispersion liquid (p) is continuously added to the colorant dispersion liquid (c), the binder resin dispersion liquid (p) is preferably added to the colorant dispersion liquid (c) at a constant addition speed. The addition speed is appropriately determined in accordance with a blending amount and the like.

A blending ratio of the colorant dispersion liquid (c) and the binder resin dispersion liquid (p) corresponds to a mass ratio which is represented by "binder resin/colorant". The blending ratio is preferably equal to or greater than 1, and more preferably in a range of 1 to 3. When such a mass ratio is equal to or greater than the preferable lower limit value, it is easy to sufficiently cover the entire surface of the colorant particle with the binder resin particles. When such a mass ratio is equal to or less than the preferable upper limit value, the fixability or the glittering properties are easily ensured.

When the binder resin dispersion liquid (p) is added to the colorant dispersion liquid (c), the optional component (1) such as the releasing agent and the electrification control agent may be added. At this time, a liquid mixture of the binder resin dispersion liquid (p) and the optional component (1) may be added further.

The binder resin dispersion liquid (p) may be added further to the aggregate dispersion liquid obtained after the binder resin dispersion liquid (p) is added to the colorant dispersion liquid (c). Thus, the surface of the colorant particle is sufficiently covered with the binder resin particles.

The fusion-bonding process (Act104) will be described hereinafter.

In the fusion-bonding process (Act104), the aggregates which are generated in the above-described aggregating process are heated. Thus, fusion bonded particles are obtained by performing fusion bonding on the colorant particle and the binder resin particles which form the aggregate. An operation in the fusion-bonding process may be performed simultaneously with an operation in the above-described aggregating process.

A heating temperature for the aggregate dispersion liquid is set, considering the types of colorant and binder resin, a melting temperature, and the like. A heating period of time of the aggregate dispersion liquid is preferably in a range of substantially 2 hours to 10 hours.

The cleaning process (Act105) will be described below.

In the cleaning process (Act105), the fusion bonded particles after the above-described fusion-bonding process are cleaned. A known cleaning method is used as a cleaning method of the fusion bonded particles. For example, the fusion bonded particles are cleaned by repeating washing and filtering with ion exchange water, and preferably, repetition is performed until conductivity of the liquid becomes equal to or less than 50 μS/cm.

The drying process (Act106) will be described below.

In the drying process (Act106), the first toner is obtained by drying the fusion bonded particles, which are subjected to the above-described cleaning process.

A known drying method is used as a drying method of the fusion bonded particles. An operation for drying the fusion bonded particles is performed by a vacuum dryer, for example. Preferably, the drying process is performed until the moisture content of the fusion bonded particles becomes equal to or less than 1.0 wt %.

In manufacturing the first toner, a process to add an external material may be performed after the drying process (Act106). In the process to add the external material, the toner particles which are subjected to the above-described drying process is mixed with the external additive.

Characteristics of the first toner will be described below.

In the first toner, the plate-like colorant particle is covered with the binder resin particles.

In the present disclosure, "the colorant particle being covered with the binder resin particles" means that 50% or more of a surface area of the colorant particle is covered with the binder resin particles. In the first toner according to the present embodiment, preferably 90% or more of the surface area of the colorant particle, more preferably 100% of the surface area of the colorant particle is covered with the binder resin particles. It is confirmed that the colorant particle is covered with the binder resin particles, by observing a particle surface of a sample using an SEM, and performing surface processing, surface element analysis, or the like.

The particle group (t1) content in the first toner is preferably equal to or greater than 90 wt %, and may be 100 wt %.

The aspect ratio (long diameter/short diameter) of the first toner is preferably equal to or greater than 3, more preferably equal to or greater than 10, and further preferably in a range of 20 to 40.

When the aspect ratio of the first toner is equal to or greater than the preferable lower limit value, coloring properties are easily obtained when an image is formed. If the aspect ratio of the first toner is less than the preferable lower limit value, an amount of the binder resin increases, and the toner has an excessive thickness. Thus, irregularity in an orientation of the toner on an image surface occurs easily. As a result, the coloring properties are likely to be decreased.

When the aspect ratio of the first toner is equal to or less than the preferable upper limit value, improved fixability is obtained. If the aspect ratio of the first toner exceeds the preferable upper limit value, that is, the toner becomes thinner, the amount of the binder resin becomes insufficient due to the thinner toner, and thus a desired fixability may not be obtained.

The volume average particle size of the first toner is preferably in a range of 6 μm to 350 μm, and more preferably in a range of 6 μm to 300 μm. When the volume average particle size of the first toner is equal to or greater than the preferable lower limit value, the sufficient coloring properties are obtained when an image is formed. When the volume average particle size of the first toner is equal to or less than the preferable upper limit value, developing, transferring, and the like in the electrophotographic processing are easily controlled.

The configuration of the second toner will be described below.

The second toner does not contain the colorant, and contains a particle group (particle group (t2)) of particles which includes a binder resin and a releasing agent, as a main component.

Examples of the binder resin, which is used in the second toner, include a polyester resin, a polystyrene resin, and the like.

The polyester resin and the polystyrene resin in the second toner respectively include substances which are similar to the polyester resin and the polystyrene resin in the first toner.

The weight-average molecular weight (Mw) of the binder resin which is used in the second toner is similar to Mw of the binder resin which is used in the first toner.

As the binder resin, only one type of binder resin may be used, or two or more types of binder resins may be used together.

Among binder resins, the polyester resin is preferable from a viewpoint of a low glass transition temperature (Tg) and excellence in low-temperature fixability. The glass transition temperature (Tg) and the acid number of such a polyester resin are respectively similar to Tg and the acid number of the polyester resin in the first toner.

The content of the binder resin in the second toner is appropriately set in accordance with the releasing agent content. The content of the binder resin is preferably equal to or greater than, for example, 75 wt % with respect to the total amount of the second toner, more preferably in a range of 78 wt % to 97 wt %, and further preferably in a range of 80 wt % to 95 wt %. If the content of the binder resin is less than the preferable lower limit value, it is difficult to ensure the fixability and the fastness of an image. If the binder resin content exceeds the preferable upper limit value, it is difficult to ensure the fixability and the glittering properties, and the toner scattering is likely to occur.

As the releasing agent used in the second toner, a substance which is similar to the releasing agent in the above-described optional component (1) is included.

As the releasing agent, only one type of releasing agent may be used, or two or more types of releasing agents may be used together.

Among releasing agents, from a viewpoint of an excellent effect to suppress the offset, the aliphatic hydrocarbon wax, the botanical wax, and the ester wax which contains fatty acid ester as a main component are preferable. Among these, the paraffin wax, the carnauba wax, and the ester wax which contains a palmitic acid ester as a main component are more preferable.

The content of the releasing agent in the second toner is in a range of 4 wt % to 24 wt % with respect to the total amount of the second toner, and preferably in a range of 5 wt % to 20 wt %.

When the releasing agent content is equal to or less than the preferable upper limit value, fixability to a recording medium is enhanced further. When the releasing agent content is equal to or greater than the preferable lower limit value, the offset is easily suppressed.

The second toner may contain another component (optional component (2)) as necessary, other than the binder resin and the releasing agent without the colorant. As the example of the optional component (2), a substance similar to the above-described optional component (1) is included.

Characteristics of the second toner will be described below.

The content of the particle group (t2) in the second toner is preferably equal to or greater than 95 wt %, more preferably equal to or greater than 98 wt %, and may be 100 wt %.

The aspect ratio (long diameter/short diameter) of the second toner is equal to or less than 3, preferably equal to or less than 2, and more preferably equal to or less than 1.5.

When the aspect ratio of the second toner is equal to or less than the upper limit value, a fixation assistant effect due to the second toner is easily obtained.

The volume average particle size of the second toner is preferably in a range of 3 μm to 12 μm, and more preferably in a range of 4 μm to 10 μm. If the volume average particle size of the second toner is equal to or less than the preferable lower limit value, the particle size of the toner is small, and it is difficult to obtain the fixation assistant effect for the first toner due to the second toner. When the volume average particle size of the second toner is equal to or less than the preferable upper limit value, the first toner is likely to be oriented in parallel to a recording medium, and the coloring properties can be obtained.

A manufacturing method of the second toner will be described below.

The manufacturing method of the second toner is not particularly limited, but a known manufacturing method of a toner is included. Examples of the manufacturing method of a toner include a pulverization method, a chemical method (aggregation fusion method, an emulsion polymerization method, a phase inversion emulsification method, and the like), and the like.

An embodiment of the manufacturing method of the second toner will be described.

When, the second toner is manufactured using a pulverization method, first, a toner material mixture is prepared by mixing the binder resin, the releasing agent, and the optional component (2) (as necessary) with each other. Then, the toner material mixture is heated, melt-kneaded (mixing and melt kneading process). Then, after cooling, pulverizing is performed (pulverizing process). Then, classification treatment is performed, and thus the second toner is obtained (classifying process).

In the manufacturing process of the second toner, the external adding process may be provided after the classifying process.

Another embodiment of the manufacturing method of the second toner will be described below.

Figure 2:
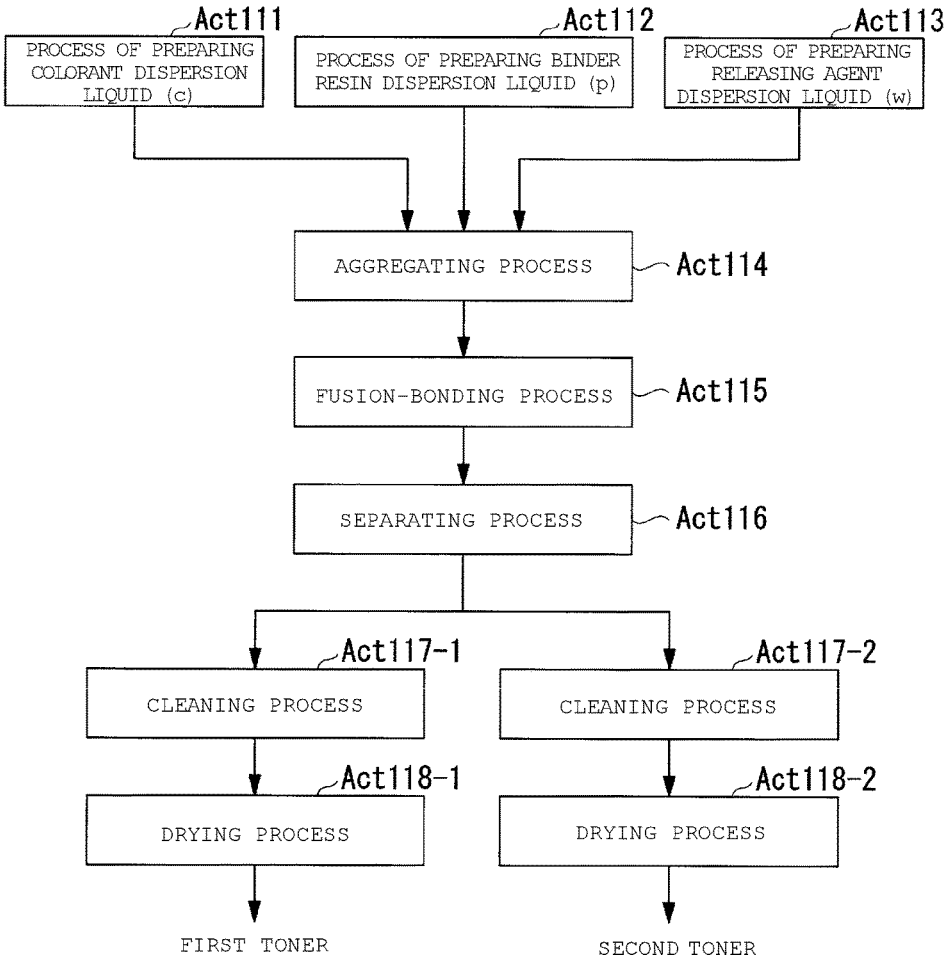
FIG. 2 is a flow chart illustrating a manufacturing method of the first toner and a second toner.

FIG. 2 is a flowchart illustrating a manufacturing method of the first toner and the second toner.

The embodiment illustrated in FIG. 2 includes a process (Act111) of preparing the colorant dispersion liquid (c), a process (Act112) of preparing the binder resin dispersion liquid (p), a process (Act113) of preparing a releasing agent dispersion liquid (w), an aggregating process (Act114), a fusion-bonding process (Act115), a separating process (Act116), a cleaning process (Act117-1), a drying process (Act118-1), a cleaning process (Act117-2), and a drying process (Act118-2).

The process (Act111) of preparing the colorant dispersion liquid (c) is similar to the above-described process (Act101) of preparing the colorant dispersion liquid (c).

The process (Act112) of preparing the binder resin dispersion liquid (p) is similar to the above-described process (Act102) of preparing the binder resin dispersion liquid (p).

The process (Act113) of preparing the releasing agent dispersion liquid (w) will be described below.

The releasing agent dispersion liquid (w) is a liquid in which releasing agent particles are dispersed.

The content of the releasing agent in the releasing agent dispersion liquid (w) is appropriately set in accordance with the concentration of the colorant, the type of binder resin, or the like. The content of the releasing agent in the releasing agent dispersion liquid (w) is preferably in a range of 30 wt % to 50 wt % with respect to the total amount of the releasing agent dispersion liquid (w).

As a dispersion medium in the releasing agent dispersion liquid (w), for example, an aqueous medium is used. Examples of the aqueous medium include water, a solvent mixture of water and an organic solvent, and the like, and water is preferable among these media.

The releasing agent dispersion liquid (w) may contain a component (optional component (w)) other than the releasing agent and the dispersion medium. As the optional component (w), for example, a surfactant, an amine compound, and the like are included. As the surfactant and the amine compound in the optional component (w), substances similar to the surfactant and the amine compound, which are described above as the optional component (l), are included.

For example, the releasing agent dispersion liquid (w) is prepared by mixing the dispersion medium, the releasing agent, and the optional component (w) (as necessary) with each other. When the releasing agent dispersion liquid (w) is prepared, mechanical shearing power is applied to disperse substances in the liquid mixture, and thereby the releasing agent is pulverized.

The shape of the releasing agent particle is not particularly limited. Examples of the shape of the releasing agent particle include a spherical shape, a cylindrical shape, a plate shape, and the like. Among these shapes, the spherical shape is preferable because the colorant particle and the binder resin particle are more likely to be aggregated.

The volume average particle size of the releasing agent particles in the releasing agent dispersion liquid (w) is preferably in a range of 0.025 μm to 0.60 μm, and more preferably in a range of 0.030 μm to 0.55 μm.

When the volume average particle size of the releasing agent particles is equal to or greater than the preferable lower limit value, it is difficult to form an aggregate (homo-particle) of the releasing agent particles. When the volume average particle size of the particle group of releasing agent particles is equal to or less than the preferable upper limit value, respective aggregation with the colorant particle and the binder resin particle is easily performed.

A ratio (binder resin particles/releasing agent particles) of the volume average particle size of the particle group of binder resin particles and the volume average particle size of the particle group of releasing agent particles is preferably equal to or greater than 1, and more preferably in a range of 1 to 2. When such a ratio of the volume average particle sizes is equal to or greater than the preferable lower limit value, the coloring properties are more easily obtained when an image is formed. When the ratio of the volume average particle sizes is equal to or less than the preferable upper limit value, fixability can be improved.

The aggregating process (Act114) will be described below.

In the aggregating process (Act114), for example, the binder resin dispersion liquid (p) and the releasing agent dispersion liquid (w) are added to the colorant dispersion liquid (c). At this time, the plate-like colorant particle, the binder resin particles, and the releasing agent particles are aggregated. Thus, an aggregate dispersion liquid in which aggregates obtained by covering the surface of the colorant particles with the binder resin particles and the releasing agent particles are dispersed is obtained. Particles which do not contain the colorant particles are also dispersed in the aggregate dispersion liquid. As the particle which does not contain the colorant particle, for example, the binder resin particle, the releasing agent particle, an aggregate of the binder resin particle, and the releasing agent particle are included.

An adding method of the binder resin dispersion liquid (p) and the releasing agent dispersion liquid (w) may be a method in which a mixture dispersion liquid (pw) of the binder resin dispersion liquid (p) and the releasing agent dispersion liquid (w) is added, or a method in which each dispersion liquid is individually added.

A ratio (mass ratio) (binder resin/releasing agent) of the binder resin and the releasing agent in the mixture dispersion liquid (pw) is preferably in a range of 2 to 25, more preferably in a range of 3 to 20, and further preferably in a range of 4 to 16.

When the binder resin dispersion liquid (p) and the releasing agent dispersion liquid (w) are added to the colorant dispersion liquid (c), it is preferable that each of the dispersion liquids and the mixture dispersion liquid (pw) is added little by little with taking the time, to the total amount of the colorant dispersion liquid (c).

A predetermined amount of each of the dispersion liquids or the mixture dispersion liquid (pw) may be continuously added or may be intermittently added. To easily and densely cover the surface of the colorant particle with the binder resin particles and the releasing agent particles, it is preferable that the predetermined amount of each of the dispersion liquids or the mixture dispersion liquid (pw) is continuously added to the colorant dispersion liquid (c). When the predetermined amount of each of the dispersion liquids or the mixture dispersion liquid (pw) is continuously added to the colorant dispersion liquid (c), each of the dispersion liquids or the mixture dispersion liquid (pw) is preferably added to the colorant dispersion liquid (c) at a constant addition speed. The addition speed is appropriately determined in accordance with a blending amount and the like.

A blending ratio of the colorant dispersion liquid (c) and the binder resin dispersion liquid (p) corresponds to a mass ratio which is represented by "binder resin/colorant". The blending ratio is preferably equal to or greater than 1, and more preferably in a range of 1 to 2.

A blending ratio of the colorant dispersion liquid (c) and the releasing agent dispersion liquid (w) corresponds to a mass ratio which is represented by "releasing agent/colorant". The blending ratio is preferably in a range of 0.05 to 0.80, and more preferably in a range of 0.10 to 0.60.

When these mass ratios are equal to or greater than the preferable lower limit value, it is easy to sufficiently cover the entire surface of the colorant particle with the binder resin particles and the releasing agent particles. When such mass ratios are equal to or less than the preferable upper limit value, the fixability or the glittering properties can be more reliably obtained.

When each of the dispersion liquids or the mixture dispersion liquid (pw) is added to the colorant dispersion liquid (c), the releasing agent, the electrification control agent, or the like may be added more.

The binder resin dispersion liquid (p) or the releasing agent dispersion liquid (w) may be added more to the aggregate dispersion liquid obtained after each of the dispersion liquids or the mixture dispersion liquid (pw) is added to the colorant dispersion liquid (c). Thus, the surface of the colorant particle is sufficiently covered with the binder resin particles or the releasing agent particles.

The fusion-bonding process (Act115) will be described below.

In the fusion-bonding process (Act115), the aggregates which are generated in the above-described aggregating process (Act114) are heated. Thus, fusion bonded particles are obtained by performing fusion bonding on the colorant particle, the binder resin particles, and the releasing agent particles which form the aggregate, for example. An operation in the fusion-bonding process (Act115) may be performed simultaneously with an operation in the above-described aggregating process (Act114).

A heating temperature for the aggregate dispersion liquid is determined considering the types of the colorant, the binder resin, and the releasing agent, a melting temperature, and the like. A heating period of time of the aggregate dispersion liquid is preferably in a range of substantially 2 hours to 10 hours.

The separating process (Act116) will be described below.

In the separating process (Act116), a particle which contains the colorant and a particle which does not contain the colorant, both of the particles existing in the aggregate dispersion liquid subjected to the above-described fusion-bonding process are separated from each other. As an operation of such separation, for example, sedimentation separation is included. The particle containing the colorant is deposited in the dispersion liquid by the sedimentation separation and the particle which does not contain the colorant floats in the dispersion liquid.

Examples of a method of the sedimentation separation include a method of performing separation using the gravity, a centrifugal force, a Coulomb's force by charges on a particle surface, and the like.

Then, the particle which contains the colorant and the particle which does not contain the colorant are selectively separated from the dispersion liquid.

The cleaning process (Act117-1) and the drying process (Act118-1) will be described below.

In the cleaning process (Act117-1), the particle which contains the colorant and is separated in the above-described separating process (Act116) is cleaned. A cleaning method of the particle which contains the colorant is similar to the above-described cleaning process (Act105).

In the drying process (Act118-1), the particle which contains the colorant and is subjected to the above-described cleaning process (Act117-1) is dried, and thereby the first toner is obtained. An operation of drying the particle is similar to the above-described drying process (Act106).

The cleaning process (Act117-2) and the drying process (Act118-2) will be described below.

In the cleaning process (Act117-2), the particle which does not contain the colorant and is separated in the above-described separating process (Act116) is cleaned. A cleaning method of the particle which does not contain the colorant is similar to the above-described cleaning process (Act105).

In the drying process (Act118-2), the particle which does not contain the colorant and is subjected to the above-described cleaning process (Act117-2) is dried, and thereby the second toner is obtained. An operation of drying the particle is similar to the above-described drying process (Act106).

According to the manufacturing method of the present embodiment illustrated in FIG. 2, the second toner along with the first toner is manufactured. An amount of the second toner which is manufactured by the manufacturing method according to the present embodiment is preferably in a range of substantially 1 wt % to 30 wt % with respect to the summation amount (100 wt %) of the first toner and the second toner, and more preferably in a range of substantially 1 wt % to 18 wt %.

In the embodiment illustrated in FIG. 2, the external adding process may be provided after the drying process (Act118-1). In addition, the external adding process may be provided after the drying process (Act118-2), A ratio (first toner/second toner) of the volume average particle size of the first toner and the volume average particle size of the second toner is preferably greater than 1, more preferably in a range of 10 to 50, and further preferably in a range of 20 to 40.

When the ratio (first toner/second toner) of the volume average particle sizes is equal to or greater than the preferable lower limit value, coloring properties are more easily obtained. When the ratio of the volume average particle sizes is equal to or less than the preferable upper limit value, improved fixability is obtained.

In a toner composition of the embodiment, it is preferable that the short diameter (P) of the first toner and the volume average particle size (Q) of the second toner satisfies the following Expression (I).

$$0.4Q \leq P \leq 2.0Q \quad \text{(I)}$$

A relationship on a left side in Expression (I) is satisfied, and thus a fixation assistant effect for the first toner due to the second toner can be more easily obtained. A relationship on a right side in Expression (I) is satisfied, and thus the first toner is easily oriented in parallel with a recording medium, and the coloring properties are easily obtained when an image is formed.

In the toner composition of the present embodiment, regarding a ratio (toner ratio) of the first toner and the second toner, the second toner is 1 to 75 parts by mass with respect to 100 parts by mass of the first toner. Preferably, the second toner is 10 to 65 parts by mass with respect to 100 parts by mass of the first toner.

When a ratio of the second toner is equal to or greater than the lower limit value, fixability is enhanced and occurrence of the offset is suppressed. When the ratio of the second toner is equal to or less than the upper limit value, the first toner is easily oriented in parallel with a recording medium, and the coloring properties are easily obtained.

The toner ratio is obtained by, for example, collecting a toner at a portion of an image which is transferred onto a recording medium and is not fixed, and measuring particle size distribution of the toner.

When the toner composition is a toner composition mixture (mixture of the first toner and the second toner), the toner ratio corresponds to a mixture ratio of the first toner and the second toner in the toner composition mixture.

The above-described toner composition according to the embodiment contains the first toner containing the plate-like colorant particles, and the second toner which does not the colorant. When an image is formed, using of the first toner causes clearly glossy feeling to be expressed. The second toner assists to fix the first toner onto a recording medium. For this reason, when an image is formed on a recording medium, good fixability is obtained. In an image which is formed on a recording medium, a flat reflective surface of the colorant particle is likely to be oriented in parallel with an image surface. Accordingly, the toner composition according to the present embodiment allows a printed matter (image having coloring properties) to which glossy feeling is applied to be formed.

When the toner composition according to the present embodiment is the toner composition mixture (mixture of the first toner and the second toner), the toner composition mixture is stored in, for example, a developing device which is included in an image forming apparatus such as a multi-function peripheral (MFP), and is used for forming an image on a recording medium employing an electrophotographic method.

The toner composition mixture is suitably used for a developer. Examples of the developer include a non-magnetic single-component developer, a two-component series developer, or the like. For example, the two-component series developer contains the toner composition mixture and a carrier. The carrier is not particularly limited and may be selected in accordance with a purpose.

An image forming apparatus according to the present embodiment will be described with reference to the accompanying drawings.

Figure 3:
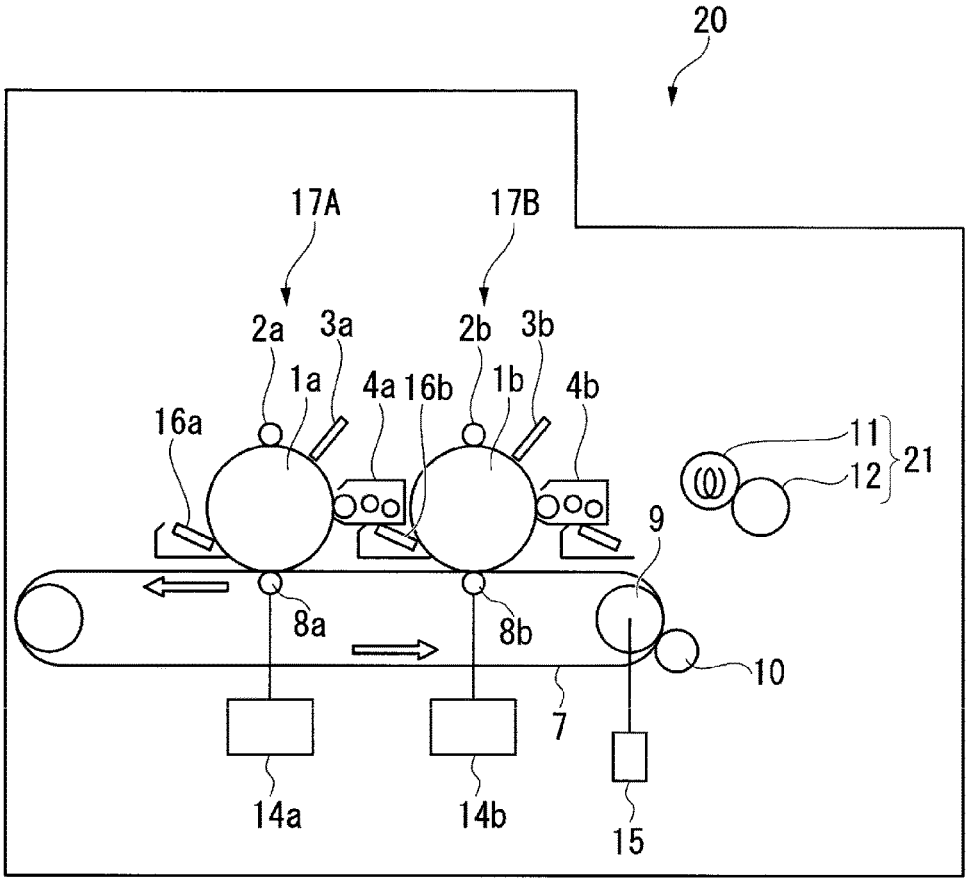
FIG. 3 is a schematic diagram illustrating an image forming apparatus according to an embodiment.

FIG. 3 illustrates a schematic structure of the image forming apparatus according to the present embodiment.

The image forming apparatus 20 has the main body which includes an intermediate transfer belt 7, a first image forming unit 17A, a second image forming unit 17B, and a fixing device 21. The first image forming unit 17A and the second image forming unit 17B are provided above the intermediate transfer belt 7. The fixing device 21 is provided on a downstream side of the intermediate transfer belt 7. The first image forming unit 17A is provided on a downstream side of the second image forming unit 17B in a movement direction of the intermediate transfer belt 7, that is, in a proceeding direction of an image forming process. The fixing device 21 is provided downstream with respect to the first image forming unit 17A in a medium conveying direction.

The first image forming unit 17A includes a photoconductive drum 1*a*, a cleaning device 16*a*, a charging device 2*a*, an exposure device 3*a*, a first developing device 4*a*, and a primary transfer roller 8*a*. The cleaning device 16*a*, the charging device 2*a*, the exposure device 3*a*, and the first developing device 4*a* are provided above the photoconductive drum 1*a* in this order along a rotational direction of the photoconductive drum 1*a*. The primary transfer roller 8*a* is provided so as to face the photoconductive drum 1*a* with the intermediate transfer belt 7 interposed between the primary transfer roller 8*a* and the photoconductive drum 1*a*.

The second image forming unit 17B includes a photoconductive drum 1*b*, a cleaning device 16*b*, a charging device 2*b*, an exposure device 3*b*, a second developing device 4*b*, and a primary transfer roller 8*b*. The cleaning device 16*b*, the charging device 2*b*, the exposure device 3*b*, and the second developing device 4*b* are provided above the photoconductive drum 1*b* in this order along a rotational direction of the photoconductive drum 1*b*. The primary transfer roller 8*b* is provided so as to face the photoconductive drum 1*b* with the intermediate transfer belt 7 disposed between the primary transfer roller 8*b* and the photoconductive drum 1*b*.

At least one of the first developing device 4*a* and the second developing device 4*b* stores a developer (single-component developer or two-component series developer) which contains a toner. This toner may be supplied from the toner cartridge (not illustrated).

A primary transfer power source 14*a* is connected to the primary transfer roller 8*a*. A primary transfer power source 14*b* is connected to the primary transfer roller 8*b*.

A secondary transfer roller 9 and a backup roller 10 are disposed downstream with respect to the first image forming unit 17A in a rotational direction of the intermediate transfer belt 7, so as to face each other across the intermediate transfer belt 7. A secondary transfer power source 15 is connected to the secondary transfer roller 9.

The fixing device 21 includes a heat roller 11 and a pressing roller 12 which are disposed so as to face each other.

First Embodiment

An image forming apparatus 20 according to a first embodiment includes the first developing device 4*a* containing the toner composition mixture. The toner composition mixture is a mixture of 100 parts by mass of the above-described first toner and 1 to 75 parts by mass of the above-described second toner.

An image forming method performed by the image forming apparatus 20 according to the first embodiment will be described below. First, the charging device 2*a* charges the photoconductive drum 1*a* uniformly. Then, the exposure device 3*a* performs exposing and thereby an electrostatic latent image is formed. Then, developing is performed with the toner composition mixture which is supplied from the first developing device 4*a*, and thereby a first toner image is obtained.

Then, the first toner image is transferred onto the intermediate transfer belt 7 using the primary transfer roller 8*a*. Then, the first toner image on the intermediate transfer belt 7 is secondary transferred onto a recording medium (not illustrated) between the secondary transfer roller 9 and the backup roller 10. Thus, a first toner image formed of the toner composition which contains 100 parts by mass of the first toner and 1 to 75 parts by mass of the second toner is formed on the recording medium.

Then, the recording medium on which the first toner image is formed passes through between the heat roller 11 and the pressing roller 12 while the recording medium is heated and pressed. As a result, the first toner image is fixed on the recording medium and thereby an image is formed.

According to the image forming method performed by the image forming apparatus 20 according to the first embodiment, an image which has the good fixability and the high coloring properties are formed.

In the first embodiment, the developer for which the toner composition mixture is used may be stored in the first developing device 4*a*.

In the image forming apparatus 20 according to the first embodiment, the first developing device 4*a* is used.

Alternatively, the second developing device 4*b* may be used. In addition, both of the first developing device 4*a* which stores the toner composition mixture, and the second developing device 4*b* which stores the toner composition mixture may be used.

Second Embodiment

In an image forming apparatus 20 according to a second embodiment, the above-described first toner is stored in the first developing device 4*a*, the above-described second toner is stored in the second developing device 4*b*, and a toner image formed of the toner composition which contains 100 parts by mass of the first toner, and 1 to 75 parts by mass of the second toner is formed on a recording medium.

An image forming method performed by the image forming apparatus 20 according to the second embodiment will be described below. First, the charging device 2*b* charges the photoconductive drum 1*b* uniformly. Then, the exposure device 3*b* performs exposing and thereby an electrostatic latent image is formed. Then, developing is performed with the second toner which is supplied from the second developing device 4*b*, and thereby a second toner image is obtained.

The charging device 2*a* charges the photoconductive drum 1*a* uniformly. Then, the exposure device 3*a* performs exposing based on first image information (second toner image), and thereby an electrostatic latent image is formed. Then, developing is performed with the first toner supplied from the first developing device 4*a*, and thereby a first toner image is obtained.

Then, the second toner image and the first toner image are transferred on the intermediate transfer belt 7 in this order by the primary transfer rollers 8*b* and 8*a*. Then, an image obtained by stacking the second toner image and the first toner image on the intermediate transfer belt 7 in this order is secondarily transferred to a recording medium (not illustrated) between the secondary transfer roller 9 and the backup roller 10. Thus, an image formed of 100 parts by mass of the first toner and an image formed of 1 to 75 parts by mass of the second toner are stacked, and a toner image obtained by performing stacking is formed on the recording medium.

Then, the recording medium on which the toner image is formed passes through between the heat roller 11 and the pressing roller 12 while the recording medium is heated and pressed. As a result, the toner image is fixed on the recording medium and thereby an image is formed.

According to the image forming method performed by the image forming apparatus 20 according to the second embodiment, an image which has the good fixability and the high coloring properties is formed. In addition, the offset of an image can be suppressed, and the glittering properties can be obtained.

In the second embodiment, the first developing device 4*a* may store a developer which uses the first toner. The second developing device 4*b* may store a developer which uses the second toner.

Third Embodiment

In an image forming apparatus 20 according to a third embodiment, the above-described second toner is stored in the first developing device 4*a*, the above-described first toner is stored in the second developing device 4*b*, and a toner image formed of the toner composition which contains 100 parts by mass of the first toner and 1 to 75 parts by mass of the second toner is formed on a recording medium.

An image forming method performed by the image forming apparatus 20 according to the third embodiment will be described below.

At first, the charging device 2*b* charges the photoconductive drum 1*b* uniformly. Then, the exposure device 3*b* performs exposing and an electrostatic latent image is formed. Then, developing is performed with the first toner supplied from the second developing device 4*b*, and thereby a first toner image is obtained.

The charging device 2*a* charges the photoconductive drum 1*a* uniformly. Then, the exposure device 3*a* performs exposing based on first image information (first toner image) and thereby an electrostatic latent image is formed. Then, developing is performed with the second toner supplied from the first developing device 4*a*, and thereby a second toner image is obtained.

Then, the first toner image and the second toner image are respectively transferred to the intermediate transfer belt 7 in this order by the primary transfer rollers 8*b* and 8*a*. Then, a toner image obtained by stacking the first toner image and the second toner image on the intermediate transfer belt 7 in this order is secondarily transferred to a recording medium (not illustrated) between the secondary transfer roller 9 and the backup roller 10. Thus, an image formed of 1 to 75 parts by mass of the second toner and an image formed of 100 parts by mass of the first toner are stacked, and a toner image obtained by performing stacking is formed on the recording medium.

Then, the recording medium on which the toner image is formed passes through between the heat roller 11 and the pressing roller 12 while the recording medium is heated and pressed. As a result, the toner image is fixed on the recording medium and thereby an image is formed.

According to the image forming method performed by the image forming apparatus 20 according to the third embodiment, an image which has the good fixability and the high coloring properties is formed. In addition, the offset of an image and contamination of the first toner in the fixing device 21 can be suppressed.

In the third embodiment, the first developing device 4*a* may store a developer which uses the second toner. The second developing device 4*b* may store a two-component series developer which uses the first toner.

The image forming apparatus according to each of the embodiments includes two developing device, but may include three developing devices or more in accordance with the type of toner which is used.

According to at least one embodiment which is described above, using 100 parts by mass of the first toner and 1 to 75 parts by mass of the second toner leads to an image having sufficient coloring properties and good fixability when an image is formed.

EXAMPLES

The following examples are for describing an example of the toner according to the present embodiment. However, the toner according to the present embodiment is not limited to these examples.

A measuring method of the volume average particle size of the particle group will be described below.

The volume average particle size of the particle group was measured using Multisizer 3 (product manufactured by Beckman Coulter Inc.), which is a particle size distribution measuring apparatus.

A measuring method of the aspect ratio (long diameter/short diameter) of the toner will be described below.

A value of the volume average particle size, which was measured using Multisizer 3 (product manufactured by Beckman Coulter Inc.), was used for the long diameter of the toner.

The short diameter of the toner was obtained as follows. That is, the short diameters of 100 particles on a particle side surface were measured based on an SEM image obtained by using a scanning electron microscope (SEM) (product manufactured by Carl Zeiss Corporation, 1000× magnification), and an average value of measured short diameters was set as the short diameter of the toner.

Thus, the ratio (long diameter/short diameter) was calculated, and a resultant was set as the aspect ratio of the toner.

A method of obtaining "a ratio (parts by mass) of the second toner to 100 parts by mass of the first toner" will be described below.

A toner image was transferred onto a surface of paper using an image forming method which will be described hereinafter, and the toner at a not-fixed image portion before fixation was collected. Then, the particle size distribution (volume as reference) of the toner was measured using Multisizer 3 (product manufactured by Beckman Coulter Inc.), which is the particle size distribution measuring apparatus. An amount of the first toner and an amount of the second toner which were in the collected toner were obtained, and the ratio (parts by mass) of the second toner to 100 parts by mass of the first toner was calculated.

An image forming method will be described below.

The toner according to each of the embodiments, and a ferrite carrier which was covered with a silicone resin were mixed with each other, and thereby a developer was prepared. At this time, the concentration of the ferrite carrier in the developer was set such that the concentration with respect to the toner was 8 wt %.

An image was formed using an electrophotographic combined machine MFP (product manufactured by Toshiba Tec Corporation, e-studio 4520c) which is the same as the image forming apparatus according to the embodiment illustrated in FIG. 3. The image was formed using each of the three following image forming methods X to Z.

Image Forming Method X:

Use of an image forming apparatus in which the second developing device stored a developer which contained the first toner and the first developing device stored a developer which contained the second toner.

Image Forming Method Y:

Use of an image forming apparatus in which the second developing device stored a developer containing the second toner and the first developing device stored a developer containing the first toner.

Image Forming Method Z:

Use of an image forming apparatus in which only the first developing device stores a developer containing a mixture of the first toner and the second toner.

A manufacturing method of the first toner which contains the colorant and a manufacturing method of the second toner which does not contain the colorant will be described below.

Example 1

A process of preparing a binder resin dispersion liquid (p1) will be described below.

As the binder resin, a polyester resin (acid number: 10 mgKOH/g, Mw: 15000, and Tg: 58° C.) which was condensation polymer of terephthalic acid and ethylene glycols was used.

30 parts by mass of the polyester resin, 1 part by mass of sodium dodecylbenzenesulfonate (product manufactured by Kao Corporation, Neopelex G15) as the anionic surfactant, and 69 parts by mass of the ion exchange water were mixed with each other, and thereby a dispersion liquid (p0) in which pH is adjusted to be 12 with potassium hydroxide was prepared.

The dispersion liquid (p0) was put into NANO 3000 (product manufactured by Be-ryu System Corporation) which was a high-pressure homogenizer, and treatment at 150° C. and 150 MPa was performed. As a result, the binder resin dispersion liquid (p1) was obtained.

The volume average particle size of the binder resin dispersion liquid (p1) was measured using SALD-7000 (product manufactured by Shimadzu Corporation). As a result, a particle group of resin particles in the binder resin dispersion liquid (p1) had a volume average particle size of 0.23 μm, and sharp particle size distribution with 0.15 of the standard deviation.

A process of preparing a releasing agent dispersion liquid (w1) will be described below.

As the releasing agent, an ester wax which contained palmitate as a main component was used.

40 parts by mass of the ester wax, 4 parts by mass of sodium dodecylbenzenesulfonate (product manufactured by Kao Corporation, Neopelex G15) as the anionic surfactant, 1 part by mass of triethylamine as the amine compound, and 55 parts by mass of the ion exchange water were mixed with each other using Clearmix (product manufactured by M Technique Co., Ltd.), and thereby a liquid mixture was prepared. The liquid mixture was heated up to 80° C. in Clearmix. Then, mechanical shearing was performed at the number of revolutions of 6000 rpm in Clearmix for 30 minutes. After mechanical shearing was ended, the liquid mixture was cooled so as to have a normal temperature, and thereby a releasing agent dispersion liquid (w1) was prepared.

The volume average particle size of the releasing agent dispersion liquid (w1) was measured using SALD-7000 (product manufactured by Shimadzu Corporation). As a result, the volume average particle size of particle groups of releasing agent particles was 0.20 μm.

A process of preparing a mixture dispersion liquid (pw1) will be described.

61 parts by mass of the binder resin dispersion liquid (p1), 3 parts by mass of the releasing agent dispersion liquid (w1), and 51 parts by mass of the ion exchange water were stirred, and thereby the mixture dispersion liquid (pw1) was prepared.

A process of preparing a colorant dispersion liquid (c1) will be described below.

20 parts by mass of the 0.5 wt % polydiallyl dimethyl ammonium chloride solution were added while 13 parts by mass of a glitter pigment (product name: Iriodin 153, volume average particle size of the pigment being 60.1 μm), and 175 parts by mass of the ion exchange water were stirred. Then, a temperature rose up to 45° C. and thereby a liquid mixture (c'1) was obtained. Then, 31 parts by mass of a 30 wt % ammonium sulfate solution were added to the liquid mixture (c'1), and a resultant was held for one hour. Thus, the colorant dispersion liquid (c1) was obtained.

Aggregating Process:

The mixture dispersion liquid (pw1) was gradually added to the colorant dispersion liquid (c1) for 10 hours, and thereby an aggregate dispersion liquid (a1) was obtained.

Fusion-Bonding Process:

6 parts by mass of a polycarboxylic acid surfactant (product manufactured by Kao Corporation, POIZ 520) as the surfactant were added to the aggregate dispersion liquid (a1), and then a temperature of a resultant rose up to 65° C. Then, a resultant was left and thus a dispersion liquid in which fusion bonded particles were dispersed was obtained.

Separating Process:

The dispersion liquid which was obtained through the fusion-bonding process was left for one hour (sedimentation separation, separation by the gravity). Thus, particle groups in the dispersion liquid were divided into a dispersion liquid in which particles containing the glitter pigment were dispersed, and a dispersion liquid in which particles which did not contain the glitter pigment were dispersed.

Cleaning Process:

Filtering and cleaning operations with ion exchange water were repeated for particle groups in each of dispersion liquids. The cleaning operation was repeated until conductivity of the liquid is equal to or smaller than 2 μS/cm.

Drying Process:

A vacuum dryer dried the particle groups which were separated by the last filtering, until the moisture content of the particle groups was equal to or less than 1.0 wt %. Thus, a first toner (1) which contained the glitter pigment, and a second toner (1) which did not contain the glitter pigment were respectively obtained.

The volume average particle sizes (50% D) of the first toner (1) and the second toner (1) were measured using SALD-7000 (product manufactured by Shimadzu Corporation). As a result, the volume average particle size of particle groups of the first toner (1) was 70.1 μm, and the volume average particle size of particle groups of the second toner (1) was 6.0 μm.

An image was formed of the obtained first toner (1) and the second toner (1), using the above-described image forming method Z.

Example 2

Preparing of a mixture dispersion liquid (pw2) will be described below.

61 parts by mass of the binder resin dispersion liquid (p1), 5 parts by mass of the releasing agent dispersion liquid (w1), and 51 parts by mass of the ion exchange water were stirred, and thereby the mixture dispersion liquid (pw2) was prepared.

A process of preparing a colorant dispersion liquid (c2) will be described below.

15 parts by mass of the 0.5 wt % polydiallyl dimethyl ammonium chloride solution were added while 12 parts by mass of a glitter pigment (product name: Iriodin 163, volume average particle size of the pigment being 120.5 μm), and 179 parts by mass of the ion exchange water were stirred. Then, a temperature rose up to 45° C. and thereby a liquid mixture (c'2) was obtained. Then, 31 parts by mass of the 30 wt % ammonium sulfate solution were added to the liquid mixture (c'2), and a resultant was held for one hour. Thus, the colorant dispersion liquid (c2) was prepared.

Aggregating Process:

The mixture dispersion liquid (pw2) was gradually added to the colorant dispersion liquid (c2) for 10 hours, and thereby an aggregate dispersion liquid (a2) was obtained.

Fusion-Bonding Process:

5 parts by mass of the polycarboxylic acid surfactant (product manufactured by Kao Corporation, POIZ 520) as the surfactant were added to the aggregate dispersion liquid (a2), and then the temperature of a resultant rose up to 65° C. Then, a resultant was left and thus a dispersion liquid in which fusion bonded particles were dispersed was obtained.

Separating Process:

The dispersion liquid which was obtained through the fusion-bonding process was left for one hour (sedimentation separation). Thus, particle groups in the dispersion liquid were divided into a dispersion liquid in which particles containing the glitter pigment were dispersed, and a dispersion liquid in which particles which did not contain the glitter pigment were dispersed.

Cleaning Process:

Filtering and cleaning operations with ion exchange water were repeated for particle groups in each of dispersion liquids. The cleaning operation was repeated until conductivity of the liquid is equal to or smaller than 2 μS/cm.

Drying Process:

A vacuum dryer dried the particle groups which were separated by the last filtering, until the moisture content of the particle groups was equal to or less than 1.0 wt %. Thus, a first toner (2) which contained the glitter pigment, and a second toner (2) which did not contain the glitter pigment were respectively obtained.

The volume average particle sizes (50% D) of the first toner (2) and the second toner (2) were measured using SALD-7000 (product manufactured by Shimadzu Corporation). As a result, the volume average particle size of particle groups of the first toner (2) was 131.2 μm, and the volume average particle size of particle groups of the second toner (2) was 5.5 μm.

An image was formed of the obtained first toner (2) and the second toner (2), using the above-described image forming method Z.

Example 3

Preparing of a mixture dispersion liquid (pw3) will be described below.

60 parts by mass of the binder resin dispersion liquid (p1), 5 parts by mass of the releasing agent dispersion liquid (w1), and 51 parts by mass of the ion exchange water were stirred, and thereby the mixture dispersion liquid (pw3) was prepared.

A process of preparing a colorant dispersion liquid (c3) will be described below.

11 parts by mass of the 0.5 wt % polydiallyl dimethyl ammonium chloride solution were added while 7 parts by mass of a glitter pigment (product name: Iriodin 383, volume average particle size of the pigment being 250.7 μm), and 184 parts by mass of the ion exchange water were stirred. Then, a temperature rose up to 45° C. and thereby a liquid mixture (c'3) was obtained. Then, 31 parts by mass of the 30 wt % ammonium sulfate solution were added to the liquid mixture (c'3), and a resultant was held for one hour. Thus, the colorant dispersion liquid (c3) was prepared.

A manufacturing method of a first toner (3) which contains the colorant will be described below.

Aggregating Process:

The mixture dispersion liquid (pw3) was gradually added to the colorant dispersion liquid (c3) for 10 hours, and thereby an aggregate dispersion liquid (a3) was obtained.

Fusion-Bonding Process:

5 parts by mass of the polycarboxylic acid surfactant (product manufactured by Kao Corporation, POIZ 520) as the surfactant were added to the aggregate dispersion liquid (a3), and then the temperature of a resultant rose up to 65° C. Then, a resultant was left and thus a dispersion liquid in which fusion bonded particles were dispersed was obtained.

Cleaning Process:

Filtering and cleaning operations with ion exchange water were repeated for particle groups in the dispersion liquid which was obtained through the fusion-bonding process. The cleaning operation was repeated until conductivity of the liquid is equal to or smaller than 2 μS/cm.

Drying Process:

A vacuum dryer dried the particle groups which were separated by the last filtering, until the moisture content of the particle groups was equal to or less than 1.0 wt %. Thus, the first toner (3) which contained the glitter pigment was obtained.

The volume average particle size (50% D) of the first toner (3) was measured using SALD-7000 (product manufactured by Shimadzu Corporation). As a result, the volume average particle size of particle groups of the first toner (3) was 273.7 μm.

A manufacturing method of a second toner (3) which does not contain the colorant will be described below.

As the binder resin, a polyester resin which was obtained by performing condensation polymerization of terephthalic acid and bisphenol A was used.

As the releasing agent, the carnauba wax was used.

As the electrification control agent, a polysaccharide compound which contains aluminum and magnesium was used.

Mixing and Melt Kneading Process:

82 parts by mass of the polyester resin, 12 parts by mass of the ester wax, and 1 part by mass of the electrification control agent were mixed by a Henschel mixer, and thus a raw material mixture (m3) was prepared. Then, the raw material mixture (m3) was melt-kneaded by a biaxial kneader of which the temperature was set to 120° C., and thereby a kneaded mixture (m3a) was obtained.

Pulverizing Process:

The kneaded mixture (m3a) was coarsely pulverized by a feather mill, and thus a coarsely pulverized product (m3b) was obtained. Thus, the coarsely pulverized product (m3b) was pulverized by a jet mill.

Classifying Process:

Then, classification was performed by a rotor type classifier, and thus a second toner (3) in which the volume average particle size of particle groups was 7.2 μm was obtained.

An image was formed of the obtained first toner (3) and the second toner (3), using the above-described image forming method Y.

Example 4

Preparing of a mixture dispersion liquid (pw4) will be described below.

60 parts by mass of the binder resin dispersion liquid (p1), 8 parts by mass of the releasing agent dispersion liquid (w1), and 50 parts by mass of the ion exchange water were stirred, and thereby the mixture dispersion liquid (pw4) was prepared.

A process of preparing a colorant dispersion liquid (c4) will be described below.

7 parts by mass of the 0.5 wt % polydiallyl dimethyl ammonium chloride solution were added while 18 parts by mass of a glitter pigment (product name: Iriodin 211, volume average particle size of the pigment being 10.1 μm), and 186 parts by mass of the ion exchange water were stirred. Then, a temperature rose up to 45° C. and thereby a liquid mixture (c'4) was obtained. Then, 30 parts by mass of the 30 wt % ammonium sulfate solution were added to the liquid mixture (c'4), and a resultant was held for one hour. Thus, the colorant dispersion liquid (c4) was prepared.

A manufacturing method of a first toner (4) which contains the colorant will be described below.

Aggregating Process:

The mixture dispersion liquid (pw4) was gradually added to the colorant dispersion liquid (c4) for 10 hours, and thereby an aggregate dispersion liquid (a4) was obtained.

Fusion-Bonding Process:

5 parts by mass of the polycarboxylic acid surfactant (product manufactured by Kao Corporation, POIZ 520) as the surfactant were added to the aggregate dispersion liquid (a4), and then the temperature of a resultant rose up to 65° C. Then, a resultant was left and thus a dispersion liquid in which fusion bonded particles were dispersed was obtained.

Cleaning Process:

Filtering and cleaning operations with ion exchange water were repeated for particle groups in the dispersion liquid which was obtained through the fusion-bonding process. The cleaning operation was repeated until conductivity of the liquid is equal to or smaller than 2 μS/cm.

Drying Process:

A vacuum dryer dried the particle groups which were separated by the last filtering, until the moisture content of the particle groups was equal to or less than 1.0 wt %. Thus, the first toner (4) which contained the glitter pigment was obtained.

The volume average particle size (50% D) of the first toner (4) was measured using SALD-7000 (product manufactured by Shimadzu Corporation). As a result, the volume average particle size of particle groups of the first toner (4) was 11.9 μm.

A manufacturing method of a second toner (4) which does not contain the colorant will be described below.

A binder resin, a releasing agent, and an electrification control agent which were the same as the binder resin, the releasing agent, and the electrification control agent used in the manufacturing method of the second toner (3) were respectively used.

Mixing and Melt Kneading Process:

84 parts by mass of the polyester resin, 8 parts by mass of the ester wax, and 1 part by mass of the electrification control agent were mixed by a Henschel mixer, and thus a raw material mixture (m4) was prepared. Then, the raw material mixture (m4) was melt-kneaded by a biaxial kneader of which the temperature was set to 120° C., and thereby a kneaded mixture (m4a) was obtained.

Pulverizing Process:

The kneaded mixture (m4a) was coarsely pulverized by a feather mill, and thus a coarsely pulverized product (m4b) was obtained. Thus, the coarsely pulverized product (m4b) was pulverized by a jet mill.

Classifying Process:

Then, classification was performed by a rotor type classifier, and thus a second toner (4) in which the volume average particle size of particle groups was 5.0 μm was obtained.

An image was formed of the obtained first toner (4) and the second toner (4), using the above-described image forming method X.

Example 5

Preparing of a mixture dispersion liquid (pw5) will be described below.

60 parts by mass of the binder resin dispersion liquid (p1), 10 parts by mass of the releasing agent dispersion liquid (w1), and 50 parts by mass of the ion exchange water were stirred, and thereby the mixture dispersion liquid (pw5) was prepared.

A process of preparing a colorant dispersion liquid (c5) will be described below.

8 parts by mass of the 0.5 wt % polydiallyl dimethyl ammonium chloride solution were added while 9 parts by mass of a glitter pigment (product name: Iriodin 383, volume average particle size of the pigment being 200.3 μm), and 79 parts by mass of the ion exchange water were stirred. Then, a temperature rose up to 45° C. and thereby a liquid mixture (c'5) was obtained. Then, 30 parts by mass of the 30 wt % ammonium sulfate solution were added to the liquid mixture (c'5), and a resultant was held for one hour. Thus, the colorant dispersion liquid (c5) was prepared.

A manufacturing method of a first toner (5) which contains the colorant will be described below.

Aggregating Process:

The mixture dispersion liquid (pw5) was gradually added to the colorant dispersion liquid (c5) for 10 hours, and thereby an aggregate dispersion liquid (a5) was obtained.

Fusion-Bonding Process:

5 parts by mass of the polycarboxylic acid surfactant (product manufactured by Kao Corporation, POIZ 520) as the surfactant were added to the aggregate dispersion liquid (a5), and then the temperature of a resultant rose up to 65° C. Then, a resultant was left and thus a dispersion liquid in which fusion bonded particles were dispersed was obtained.

Cleaning Process:

Filtering and cleaning operations with ion exchange water were repeated for particle groups in the dispersion liquid which was obtained through the fusion-bonding process. The cleaning operation was repeated until conductivity of the liquid is equal to or smaller than 2 μS/cm.

Drying Process:

A vacuum dryer dried the particle groups which were separated by the last filtering, until the moisture content of the particle groups was equal to or less than 1.0 wt %. Thus, the first toner (5) which contained the glitter pigment was obtained.

The volume average particle size (50% D) of the first toner (5) was measured using SALD-7000 (product manufactured by Shimadzu Corporation). As a result, the volume average particle size of particle groups of the first toner (5) was 226.4 μm.

A manufacturing method of a second toner (5) which does not contain the colorant will be described below.

A binder resin, a releasing agent, and an electrification control agent which were the same as the binder resin, the releasing agent, and the electrification control agent used in the manufacturing method of the second toner (3) were respectively used.

Mixing and Melt Kneading Process:

85 parts by mass of the polyester resin, 7 parts by mass of the ester wax, and 1 part by mass of the electrification control agent were mixed by a Henschel mixer, and thus a raw material mixture (m5) was prepared. Then, the raw material mixture (m5) was melt-kneaded by a biaxial kneader of which the temperature was set to 120° C., and thereby a kneaded mixture (m5a) was obtained.

Pulverizing Process:

The kneaded mixture (m5a) was coarsely pulverized by a feather mill, and thus a coarsely pulverized product (m5b) was obtained. Thus, the coarsely pulverized product (m5b) was pulverized by a jet mill.

Classifying Process:

Then, classification was performed by a rotor type classifier, and thus a second toner (5) in which the volume average particle size of particle groups was 6.8 μm was obtained.

An image was formed of the obtained first toner (5) and the second toner (5), using the above-described image forming method Y.

Example 6

Preparing of a mixture dispersion liquid (pw6) will be described below.

60 parts by mass of the binder resin dispersion liquid (p1), 10 parts by mass of the releasing agent dispersion liquid (w1), and 50 parts by mass of the ion exchange water were stirred, and thereby the mixture dispersion liquid (pw6) was prepared.

A process of preparing a colorant dispersion liquid (c6) will be described below.

7 parts by mass of the 0.5 wt % polydiallyl dimethyl ammonium chloride solution were added while 12 parts by mass of a glitter pigment (product name: Iriodin 201, volume average particle size of the pigment being 7.0 μm), and 186 parts by mass of the ion exchange water were stirred. Then, a temperature rose up to 45° C. and thereby a liquid mixture (c'6) was obtained. Then, 30 parts by mass of the 30 wt % ammonium sulfate solution were added to the liquid mixture (c'6), and a resultant was held for one hour. Thus, the colorant dispersion liquid (c6) was prepared.

A manufacturing method of a first toner (6) which contains the colorant will be described below.

Aggregating Process:

The mixture dispersion liquid (pw6) was gradually added to the colorant dispersion liquid (c6) for 10 hours, and thereby an aggregate dispersion liquid (a6) was obtained.

Fusion-Bonding Process:

5 parts by mass of the polycarboxylic acid surfactant (product manufactured by Kao Corporation, POIZ 520) as the surfactant were added to the aggregate dispersion liquid (a6), and then the temperature of a resultant rose up to 65° C. Then, a resultant was left and thus a dispersion liquid in which fusion bonded particles were dispersed was obtained.

Cleaning Process:

Filtering and cleaning operations with ion exchange water were repeated for particle groups in the dispersion liquid which was obtained through the fusion-bonding process. The cleaning operation was repeated until conductivity of the liquid is equal to or smaller than 2 μS/cm.

Drying Process:

A vacuum dryer dried the particle groups which were separated by the last filtering, until the moisture content of the particle groups was equal to or less than 1.0 wt %. Thus, the first toner (6) which contained the glitter pigment was obtained.

The volume average particle size (50% D) of the first toner (6) was measured using SALD-7000 (product manufactured by Shimadzu Corporation). As a result, the volume average particle size of particle groups of the first toner (6) was 9.5 μm.

A manufacturing method of a second toner (6) which does not contain the colorant will be described below.

A binder resin, a releasing agent, and an electrification control agent which were the same as the binder resin, the releasing agent, and the electrification control agent used in the manufacturing method of the second toner (3) were respectively used.

Mixing and Melt Kneading Process:

82 parts by mass of the polyester resin, 5 parts by mass of the ester wax, and 1 part by mass of the electrification control agent were mixed by a Henschel mixer, and thus a raw material mixture (m6) was prepared. Then, the raw material mixture (m6) was melt-kneaded by a biaxial kneader of which the temperature was set to 120° C., and thereby a kneaded mixture (m6a) was obtained.

Pulverizing Process:

The kneaded mixture (m6a) was coarsely pulverized by a feather mill, and thus a coarsely pulverized product (m6b) was obtained. Thus, the coarsely pulverized product (m6b) was pulverized by a jet mill.

Classifying Process:

Then, classification was performed by a rotor type classifier, and thus a second toner (6) in which the volume average particle size of particle groups was 5.2 μm was obtained.

An image was formed using the obtained first toner (6) and the second toner (6), and using the above-described image forming method Y.

Example 7

Preparing of a mixture dispersion liquid (pw7) will be described below.

60 parts by mass of the binder resin dispersion liquid (p1), 8 parts by mass of the releasing agent dispersion liquid (w1), and 50 parts by mass of the ion exchange water were stirred, and thereby the mixture dispersion liquid (pw7) was prepared.

A process of preparing a colorant dispersion liquid (c7) will be described below.

7 parts by mass of the 0.5 wt % polydiallyl dimethyl ammonium chloride solution were added while 12 parts by mass of a glitter pigment (product name: Iriodin 259, volume average particle size of the pigment being 40.3 μm), and 193 parts by mass of the ion exchange water were stirred. Then, a temperature rose up to 45° C. and thereby a liquid mixture (c'7) was obtained. Then, 30 parts by mass of the 30 wt % ammonium sulfate solution were added to the liquid mixture (c'7), and a resultant was held for one hour. Thus, the colorant dispersion liquid (c7) was prepared.

A Manufacturing Method of a First Toner (7) which contains the colorant will be described below.

Aggregating Process:

The mixture dispersion liquid (pw7) was gradually added to the colorant dispersion liquid (c7) for 10 hours, and thereby an aggregate dispersion liquid (a7) was obtained.

Fusion-Bonding Process:

5 parts by mass of the polycarboxylic acid surfactant (product manufactured by Kao Corporation, POIZ 520) as the surfactant were added to the aggregate dispersion liquid (a7), and then the temperature of a resultant rose up to 65° C. Then, a resultant was left and thus a dispersion liquid in which fusion bonded particles were dispersed was obtained.

Cleaning Process:

Filtering and cleaning operations with ion exchange water were repeated for particle groups in the dispersion liquid which was obtained through the fusion-bonding process.

The cleaning operation was repeated until conductivity of the liquid is equal to or smaller than 50 μS/cm.

Drying Process:

A vacuum dryer dried the particle groups which were separated by the last filtering, until the moisture content of the particle groups was equal to or less than 1.0 wt %. Thus, the first toner (7) which contained the glitter pigment was obtained.

The volume average particle size (50% D) of the first toner (7) was measured using SALD-7000 (product manufactured by Shimadzu Corporation). As a result, the volume average particle size of particle groups of the first toner (7) was 45.1 μm.

A manufacturing method of a second toner (7) which does not contain the colorant will be described below.

A binder resin, a releasing agent, and an electrification control agent which were the same as the binder resin, the releasing agent, and the electrification control agent used in the manufacturing method of the second toner (3) were respectively used.

Mixing and Melt Kneading Process:

78 parts by mass of the polyester resin, 15 parts by mass of the ester wax, and 1 part by mass of the electrification control agent were mixed by a Henschel mixer, and thus a raw material mixture (m7) was prepared. Then, the raw material mixture (m7) was melt-kneaded by a biaxial kneader of which the temperature was set to 120° C., and thereby a kneaded mixture (m7a) was obtained.

Pulverizing Process:

The kneaded mixture (m7a) was coarsely pulverized by a feather mill, and thus a coarsely pulverized product (m7b) was obtained. Thus, the coarsely pulverized product (m7b) was pulverized by a jet mill.

Classifying Process:

Then, classification was performed by a rotor type classifier, and thus a second toner (7) in which the volume average particle size of particle groups was 8.8 μm was obtained.

An image was formed using the obtained first toner (7) and the second toner (7), and using the above-described image forming method X.

Example 8

A process of preparing a colorant dispersion liquid (c8) will be described below.

7 parts by mass of the 0.5 wt % polydiallyl dimethyl ammonium chloride solution were added while 12 parts by mass of a glitter pigment (product name: Iriodin 289, volume average particle size of the pigment being 50.3 μm), and 193 parts by mass of the ion exchange water were stirred. Then, a temperature rose up to 45° C. and thereby a liquid mixture (c'8) was obtained. Then, 30 parts by mass of the 30 wt % ammonium sulfate solution were added to the liquid mixture (c'8), and a resultant was held for one hour. Thus, the colorant dispersion liquid (c8) was prepared.

A manufacturing method of a first toner (8) which contains the colorant will be described below.

60 parts by mass of the binder resin dispersion liquid (p1) and 50 parts by mass of the ion exchange water were mixed, and thereby a liquid mixture (p1') was obtained. This liquid mixture (p1') was gradually added to the colorant dispersion liquid (c8) for 10 hours, and thus an aggregate dispersion liquid (a8) was obtained.

Fusion-Bonding Process:

5 parts by mass of the polycarboxylic acid surfactant (product manufactured by Kao Corporation, POIZ 520) as the surfactant were added to the aggregate dispersion liquid (a8), and then the temperature of a resultant rose up to 65° C. Then, a resultant was left and thus a dispersion liquid in which fusion bonded particles were dispersed was obtained.

Cleaning Process:

Filtering and cleaning operations with ion exchange water were repeated for particle groups in the dispersion liquid which was obtained through the fusion-bonding process. The cleaning operation was repeated until conductivity of the liquid is equal to or smaller than 2 μS/cm.

Drying Process:

A vacuum dryer dried the particle groups which were separated by the last filtering, until the moisture content of the particle groups was equal to or less than 1.0 wt %. Thus, the first toner (8) which contained the glitter pigment was obtained.

The volume average particle size (50% D) of the first toner (8) was measured using SALD-7000 (product manufactured by Shimadzu Corporation). As a result, the volume average particle size of particle groups of the first toner (8) was 53.8 μm.

A manufacturing method of a second toner (8) which does not contain the colorant will be described below.

A binder resin, a releasing agent, and an electrification control agent which were the same as the binder resin, the releasing agent, and the electrification control agent used in the manufacturing method of the second toner (3) were respectively used.

Mixing and Melt Kneading Process:

78 parts by mass of the polyester resin, 15 parts by mass of the ester wax, and 1 part by mass of the electrification control agent were mixed by a Henschel mixer, and thus a raw material mixture (m8) was prepared. Then, the raw material mixture (m8) was melt-kneaded by a biaxial kneader of which the temperature was set to 120° C., and thereby a kneaded mixture (m8a) was obtained.

Pulverizing Process:

The kneaded mixture (m8a) was coarsely pulverized by a feather mill, and thus a coarsely pulverized product (m8b) was obtained. Thus, the coarsely pulverized product (m8b) was pulverized by a jet mill.

Classifying Process:

Then, classification was performed by a rotor type classifier, and thus a second toner (8) in which the volume average particle size of particle groups was 6.6 μm was obtained.

An image was formed of the obtained first toner (8) and the second toner (8), using the above-described image forming method X.

Comparative Example 1

Preparing of a mixture dispersion liquid (pw9) will be described below.

60 parts by mass of the binder resin dispersion liquid (p1), 6 parts by mass of the releasing agent dispersion liquid (w1), and 48 parts by mass of the ion exchange water were stirred, and thereby the mixture dispersion liquid (pw9) was prepared.

A process of preparing a colorant dispersion liquid (c9) will be described below.

8 parts by mass of the 0.5 wt % polydiallyl dimethyl ammonium chloride solution were added while 12 parts by mass of a glitter pigment (product name: Iriodin 111, volume average particle size of the pigment being 1.5 μm), and 173 parts by mass of the ion exchange water were stirred. Then, a temperature rose up to 45° C. and thereby a liquid mixture (c'9) was obtained. Then, 29 parts by mass of the 30 wt % ammonium sulfate solution were added to the liquid mixture (c'9), and a resultant was held for one hour. Thus, the colorant dispersion liquid (c9) was prepared.

A manufacturing method of a first toner (9) which contains the colorant will be described below.

Aggregating Process:

The mixture dispersion liquid (pw9) was gradually added to the colorant dispersion liquid (c9) for 10 hours, and thereby an aggregate dispersion liquid (a9) was obtained.

Fusion-Bonding Process:

5 parts by mass of the polycarboxylic acid surfactant (product manufactured by Kao Corporation, POIZ 520) as the surfactant were added to the aggregate dispersion liquid (a9), and then the temperature of a resultant rose up to 65° C. Then, a resultant was left and thus a dispersion liquid in which fusion bonded particles were dispersed was obtained.

Cleaning Process:

Filtering and cleaning operations with ion exchange water were repeated for particle groups in the dispersion liquid which was obtained through the fusion-bonding process.

The cleaning operation was repeated until conductivity of the liquid is equal to or smaller than 50 μS/cm.

Drying Process:

A vacuum dryer dried the particle groups which were separated by the last filtering, until the moisture content of the particle groups was equal to or less than 1.0 wt %. Thus, the first toner (9) which contained the glitter pigment was obtained.

The volume average particle size (50% D) of the first toner (9) was measured using SALD-7000 (product manufactured by Shimadzu Corporation). As a result, the volume average particle size of particle groups of the first toner (9) was 6.2 μm.

A manufacturing method of a second toner (9) which does not contain the colorant will be described below.

A binder resin, a releasing agent, and an electrification control agent which were the same as the binder resin, the releasing agent, and the electrification control agent used in the manufacturing method of the second toner (3) were respectively used.

Mixing and Melt Kneading Process:

78 parts by mass of the polyester resin, 15 parts by mass of the ester wax, and 1 part by mass of the electrification control agent were mixed by a Henschel mixer, and thus a raw material mixture (m9) was prepared. Then, the raw material mixture (m9) was melt-kneaded by a biaxial kneader of which the temperature was set to 120° C., and thereby a kneaded mixture (m9a) was obtained.

Pulverizing Process:

The kneaded mixture (m9a) was coarsely pulverized by a feather mill, and thus a coarsely pulverized product (m9b) was obtained. Thus, the coarsely pulverized product (m9b) was pulverized by a jet mill.

Classifying Process:

Then, classification was performed by a rotor type classifier, and thus a second toner (9) in which the volume average particle size of particle groups was 6.0 μm was obtained.

An image was formed of the obtained first toner (9) and the second toner (9), using the above-described image forming method X.

Comparative Example 2

Preparing of a mixture dispersion liquid (pw10) will be described below.

60 parts by mass of the binder resin dispersion liquid (p1), 6 parts by mass of the releasing agent dispersion liquid (w1), and 53 parts by mass of the ion exchange water were stirred, and thereby the mixture dispersion liquid (pw10) was prepared.

A process of preparing a colorant dispersion liquid (c10) will be described below.

8 parts by mass of the 0.5 wt % polydiallyl dimethyl ammonium chloride solution were added while 12 parts by mass of a glitter pigment (product name: Iriodin 119, volume average particle size of the pigment being 3.5 μm), and 181 parts by mass of the ion exchange water were stirred. Then, a temperature rose up to 45° C. and thereby a liquid mixture (c'10) was obtained. Then, 32 parts by mass of the 30 wt % ammonium sulfate solution were added to the liquid mixture (c'10), and a resultant was held for one hour. Thus, the colorant dispersion liquid (c10) was prepared.

A manufacturing method of a first toner (10) which contains the colorant will be described below.

Aggregating Process:

The mixture dispersion liquid (pw10) was gradually added to the colorant dispersion liquid (c10) for 10 hours, and thereby an aggregate dispersion liquid (a10) was obtained.

Fusion-Bonding Process:

5 parts by mass of the polycarboxylic acid surfactant (product manufactured by Kao Corporation, POIZ 520) as the surfactant were added to the aggregate dispersion liquid (a10), and then the temperature of a resultant rose up to 65° C. Then, a resultant was left and thus a dispersion liquid in which fusion bonded particles were dispersed was obtained.

Cleaning Process:

Filtering and cleaning operations with ion exchange water were repeated for particle groups in the dispersion liquid which was obtained through the fusion-bonding process.

The cleaning operation was repeated until conductivity of the liquid is equal to or smaller than 50 μS/cm.

Drying Process:

A vacuum dryer dried the particle groups which were separated by the last filtering, until the moisture content of the particle groups was equal to or less than 1.0 wt %. Thus, the first toner (10) which contained the glitter pigment was obtained.

The volume average particle size (50% D) of the first toner (10) was measured using SALD-7000 (product manufactured by Shimadzu Corporation). As a result, the volume average particle size of particle groups of the first toner (10) was 4.0 μm.

A manufacturing method of a second toner (10) which does not contain the colorant will be described below.

A binder resin, a releasing agent, and an electrification control agent which were the same as the binder resin, the releasing agent, and the electrification control agent used in the manufacturing method of the second toner (3) were respectively used.

Mixing and Melt Kneading Process:

85 parts by mass of the polyester resin, 8 parts by mass of the ester wax, and 1 part by mass of the electrification control agent were mixed by a Henschel mixer, and thus a raw material mixture (m10) was prepared. Then, the raw material mixture (m10) was melt-kneaded by a biaxial kneader of which the temperature was set to 120° C., and thereby a kneaded mixture (m10a) was obtained.

Pulverizing Process:

The kneaded mixture (m10a) was coarsely pulverized by a feather mill, and thus a coarsely pulverized product (m10b) was obtained. Thus, the coarsely pulverized product (m10b) was pulverized by a jet mill.

Classifying Process:

Then, classification was performed by a rotor type classifier, and thus a second toner (10) in which the volume average particle size of particle groups was 4.5 μm was obtained.

An image was formed of the obtained first toner (10) and the second toner (10), using the above-described image forming method X.

Comparative Example 3

Preparing of a mixture dispersion liquid (pw11) will be described below.

61 parts by mass of the binder resin dispersion liquid (p1), 6 parts by mass of the releasing agent dispersion liquid (w1), and 51 parts by mass of the ion exchange water were stirred, and thereby the mixture dispersion liquid (pw11) was prepared.

A process of preparing a colorant dispersion liquid (c11) will be described below.

21 parts by mass of the 0.5 wt % polydiallyl dimethyl ammonium chloride solution were added while 10 parts by mass of a glitter pigment (product name: Iriodin 183, volume average particle size of the pigment being 400.2 μm), and 170 parts by mass of the ion exchange water were stirred. Then, a temperature rose up to 45° C. and thereby a liquid mixture (c'11) was obtained. Then, 33 parts by mass of the 30 wt % ammonium sulfate solution were added to the liquid mixture (c'11), and a resultant was held for one hour. Thus, the colorant dispersion liquid (c11) was prepared.

Aggregating Process:

The mixture dispersion liquid (pw11) was gradually added to the colorant dispersion liquid (c11) for 10 hours, and thereby an aggregate dispersion liquid (a11) was obtained.

Fusion-Bonding Process:

6 parts by mass of the polycarboxylic acid surfactant (product manufactured by Kao Corporation, POIZ 520) as the surfactant were added to the aggregate dispersion liquid (a11), and then the temperature of a resultant rose up to 65° C. Then, a resultant was left and thus a dispersion liquid in which fusion bonded particles were dispersed was obtained.

Separating Process:

The dispersion liquid which was obtained through the fusion-bonding process was left for one hour (sedimentation separation). Thus, particle groups in the dispersion liquid were divided into a dispersion liquid in which particles containing the glitter pigment were dispersed, and a dispersion liquid in which particles which did not contain the glitter pigment were dispersed.

Cleaning Process:

Filtering and cleaning operations with ion exchange water were repeated for particle groups in each of the dispersion liquids. The cleaning operation was repeated until conductivity of the liquid is equal to or smaller than 2 μS/cm.

Drying Process:

A vacuum dryer dried the particle groups which were separated by the last filtering, until the moisture content of the particle groups was equal to or less than 1.0 wt %. Thus, a first toner (11) which contained the glitter pigment, and a second toner (11) which did not contain the glitter pigment were obtained.

The volume average particle sizes (50% D) of the first toner (11) and the second toner (11) were measured using SALD-7000 (product manufactured by Shimadzu Corporation). As a result, the volume average particle size of particle groups of the first toner (11) was 430.6 μm, and the volume average particle size of particle groups of the second toner (11) was 7.5 μm.

An image was formed of the obtained first toner (11) and the second toner (11), using the above-described image forming method Z.

Comparative Example 4

Preparing of a mixture dispersion liquid (pw12) will be described below.

60 parts by mass of the binder resin dispersion liquid (p1), 6 parts by mass of the releasing agent dispersion liquid (w1), and 54 parts by mass of the ion exchange water were stirred, and thereby the mixture dispersion liquid (pw12) was prepared.

A process of preparing a colorant dispersion liquid (c12) will be described below.

8 parts by mass of the 0.5 wt % polydiallyl dimethyl ammonium chloride solution were added while 9 parts by mass of a glitter pigment (product name: Iriodin 383, volume average particle size of the pigment being 250.7 μm), and 182 parts by mass of the ion exchange water were stirred. Then, a temperature rose up to 45° C. and thereby a liquid mixture (c'12) was obtained. Then, 32 parts by mass of the 30 wt % ammonium sulfate solution were added to the liquid mixture (c'12), and a resultant was held for one hour. Thus, the colorant dispersion liquid (c12) was prepared.

A manufacturing method of a first toner (12) which contains the colorant will be described below.

Aggregating Process:

The mixture dispersion liquid (pw12) was gradually added to the colorant dispersion liquid (c12) for 10 hours, and thereby an aggregate dispersion liquid (a12) was obtained.

Fusion-Bonding Process:

5 parts by mass of the polycarboxylic acid surfactant (product manufactured by Kao Corporation, POIZ 520) as the surfactant were added to the aggregate dispersion liquid (a12), and then the temperature of a resultant rose up to 65° C. Then, a resultant was left and thus a dispersion liquid in which fusion bonded particles were dispersed was obtained.

Cleaning Process:

Filtering and cleaning operations with ion exchange water were repeated for particle groups in the dispersion liquid which was obtained through the fusion-bonding process. The cleaning operation was repeated until conductivity of the liquid is equal to or smaller than 50 μS/cm.

Drying Process:

A vacuum dryer dried the particle groups which were separated by the last filtering, until the moisture content of the particle groups was equal to or less than 1.0 wt %. Thus, a first toner (12) which contained the glitter pigment was obtained.

The volume average particle size (50% D) of the first toner (12) was measured using SALD-7000 (product manufactured by Shimadzu Corporation). As a result, the volume average particle size of particle groups of the first toner (12) was 274.3 μm.

A manufacturing method of a second toner (12) which does not contain the colorant will be described below.

A binder resin, a releasing agent, and an electrification control agent which were the same as the binder resin, the releasing agent, and the electrification control agent used in the manufacturing method of the second toner (3) were respectively used.

Mixing and Melt Kneading Process:

95 parts by mass of the polyester resin, 3 parts by mass of the ester wax, and 1 part by mass of the electrification control agent were mixed by a Henschel mixer, and thus a raw material mixture (m12) was prepared. Then, the raw material mixture (m12) was melt-kneaded by a biaxial kneader of which the temperature was set to 120° C., and thereby a kneaded mixture (m12a) was obtained.

Pulverizing Process:

The kneaded mixture (m12a) was coarsely pulverized by a feather mill, and thus a coarsely pulverized product (m12b) was obtained. Thus, the coarsely pulverized product (m12b) was pulverized by a jet mill.

Classifying Process:

Then, classification was performed by a rotor type classifier, and thus a second toner (12) in which the volume average particle size of particle groups was 5.0 μm was obtained.

An image was formed of the obtained first toner (12) and the second toner (12), using the above-described image forming method Y.

Comparative Example 5

Preparing of a mixture dispersion liquid (pw13) will be described below.

60 parts by mass of the binder resin dispersion liquid (p1), 8 parts by mass of the releasing agent dispersion liquid (w1), and 59 parts by mass of the ion exchange water were stirred, and thereby the mixture dispersion liquid (pw13) was prepared.

A process of preparing a colorant dispersion liquid (c13) will be described below.

6 parts by mass of the 0.5 wt % polydiallyl dimethyl ammonium chloride solution were added while 9 parts by mass of a glitter pigment (product name: Iriodin 163, volume average particle size of the pigment being 55.3 μm), and 189 parts by mass of the ion exchange water were stirred. Then, a temperature rose up to 45° C. and thereby a liquid mixture (c'13) was obtained. Then, 30 parts by mass of the 30 wt % ammonium sulfate solution were added to the liquid mixture (c'13), and a resultant was held for one hour. Thus, the colorant dispersion liquid (c13) was prepared.

A manufacturing method of a first toner (13) which contains the colorant will be described below.

Aggregating Process:

The mixture dispersion liquid (pw13) was gradually added to the colorant dispersion liquid (c13) for 10 hours, and thereby an aggregate dispersion liquid (a13) was obtained.

Fusion-Bonding Process:

5 parts by mass of the polycarboxylic acid surfactant (product manufactured by Kao Corporation, POIZ 520) as the surfactant were added to the aggregate dispersion liquid (a13), and then the temperature of a resultant rose up to 65° C. Then, a resultant was left and thus a dispersion liquid in which fusion bonded particles were dispersed was obtained.

Cleaning Process:

Filtering and cleaning operations with ion exchange water were repeated for particle groups in the dispersion liquid which was obtained through the fusion-bonding process.

The cleaning operation was repeated until conductivity of the liquid is equal to or smaller than 50 μS/cm.

Drying Process:

A vacuum dryer dried the particle groups which were separated by the last filtering, until the moisture content of the particle groups was equal to or less than 1.0 wt %. Thus, a first toner (13) which contained the glitter pigment was obtained.

The volume average particle size (50% D) of the first toner (13) was measured using SALD-7000 (product manufactured by Shimadzu Corporation). As a result, the volume average particle size of particle groups of the first toner (13) was 60.2 μm.

A manufacturing method of a second toner (13) which does not contain the colorant will be described below.

A binder resin, a releasing agent, and an electrification control agent which were the same as the binder resin, the releasing agent, and the electrification control agent used in the manufacturing method of the second toner (3) were respectively used.

Mixing and Melt Kneading Process:

85 parts by mass of the polyester resin, 11 parts by mass of the ester wax, and 1 part by mass of the electrification control agent were mixed by a Henschel mixer, and thus a raw material mixture (m13) was prepared. Then, the raw material mixture (m13) was melt-kneaded by a biaxial kneader of which the temperature was set to 120° C., and thereby a kneaded mixture (m13a) was obtained.

Pulverizing Process:

The kneaded mixture (m13a) was coarsely pulverized by a feather mill, and thus a coarsely pulverized product (m13b) was obtained. Thus, the coarsely pulverized product (m13b) was pulverized by a jet mill.

Classifying Process:

Then, classification was performed by a rotor type classifier, and thus a second toner (13) in which the volume average particle size of particle groups was 10.5 μm was obtained.

An image was formed of the obtained first toner (13) and the second toner (13), using the above-described image forming method Y.

Comparative Example 6

Preparing of a mixture dispersion liquid (pw14) will be described below.

60 parts by mass of the binder resin dispersion liquid (p1), 8 parts by mass of the releasing agent dispersion liquid (w1), and 59 parts by mass of the ion exchange water were stirred, and thereby the mixture dispersion liquid (pw14) was prepared.

A process of preparing a colorant dispersion liquid (c14) will be described below.

6 parts by mass of the 0.5 wt % polydiallyl dimethyl ammonium chloride solution were added while 11 parts by mass of a glitter pigment (product name: Iriodin 249, volume average particle size of the pigment being 35.5 μm), and 177 parts by mass of the ion exchange water were stirred. Then, a temperature rose up to 45° C. and thereby a liquid mixture (c'14) was obtained. Then, 34 parts by mass of the 30 wt % ammonium sulfate solution were added to the liquid mixture (c'14), and a resultant was held for one hour. Thus, the colorant dispersion liquid (c14) was prepared.

A manufacturing method of a first toner (14) which contains the colorant will be described below.

Aggregating Process:

The mixture dispersion liquid (pw14) was gradually added to the colorant dispersion liquid (c14) for 10 hours, and thereby an aggregate dispersion liquid (a14) was obtained.

Fusion-Bonding Process:

5 parts by mass of the polycarboxylic acid surfactant (product manufactured by Kao Corporation, POIZ 520) as the surfactant were added to the aggregate dispersion liquid (a14), and then the temperature of a resultant rose up to 65° C. Then, a resultant was left and thus a dispersion liquid in which fusion bonded particles were dispersed was obtained.

Cleaning Process:

Filtering and cleaning operations with ion exchange water were repeated for particle groups in the dispersion liquid which was obtained through the fusion-bonding process. The cleaning operation was repeated until conductivity of the liquid is equal to or smaller than 50 μS/cm.

Drying Process:

A vacuum dryer dried the particle groups which were separated by the last filtering, until the moisture content of the particle groups was equal to or less than 1.0 wt %. Thus, a first toner (14) which contained the glitter pigment was obtained.

The volume average particle size (50% D) of the first toner (14) was measured using SALD-7000 (product manufactured by Shimadzu Corporation). As a result, the volume average particle size of particle groups of the first toner (14) was 36.8 μm.

A manufacturing method of a second toner (14) which does not contain the colorant will be described below.

A binder resin, a releasing agent, and an electrification control agent which were the same as the binder resin, the releasing agent, and the electrification control agent used in the manufacturing method of the second toner (3) were respectively used.

Mixing and Melt Kneading Process:

84 parts by mass of the polyester resin, 11 parts by mass of the ester wax, and 1 part by mass of the electrification control agent were mixed by a Henschel mixer, and thus a raw material mixture (m14) was prepared. Then, the raw material mixture (m14) was melt-kneaded by a biaxial kneader of which the temperature was set to 120° C., and thereby a kneaded mixture (m14a) was obtained.

Pulverizing Process:

The kneaded mixture (m14a) was coarsely pulverized by a feather mill, and thus a coarsely pulverized product (m14b) was obtained. Thus, the coarsely pulverized product (m14b) was pulverized by a jet mill.

Classifying Process:

Then, classification was performed by a rotor type classifier, and thus a second toner (14) in which the volume average particle size of particle groups was 5.5 μm was obtained.

An image was formed of the obtained first toner (14) and the second toner (14), using the above-described image forming method Z.

Comparative Example 7

Preparing of a mixture dispersion liquid (pw15) will be described below.

60 parts by mass of the binder resin dispersion liquid (p1), 5 parts by mass of the releasing agent dispersion liquid (w1), and 60 parts by mass of the ion exchange water were stirred, and thereby the mixture dispersion liquid (pw15) was prepared.

A process of preparing a colorant dispersion liquid (c15) will be described below.

6 parts by mass of the 0.5 wt % polydiallyl dimethyl ammonium chloride solution were added while 13 parts by mass of a glitter pigment (product name: Iriodin 259, volume average particle size of the pigment being 40.1 μm), and 189 parts by mass of the ion exchange water were stirred. Then, a temperature rose up to 45° C. and thereby a liquid mixture (c'15) was obtained. Then, 34 parts by mass of the 30 wt % ammonium sulfate solution were added to the liquid mixture (c'15), and a resultant was held for one hour. Thus, the colorant dispersion liquid (c15) was prepared.

A manufacturing method of a first toner (15) which contains the colorant will be described below.

Aggregating Process:

The mixture dispersion liquid (pw15) was gradually added to the colorant dispersion liquid (c15) for 10 hours, and thereby an aggregate dispersion liquid (a15) was obtained.

Fusion-Bonding Process:

5 parts by mass of the polycarboxylic acid surfactant (product manufactured by Kao Corporation, POIZ 520) as the surfactant were added to the aggregate dispersion liquid (a15), and then the temperature of a resultant rose up to 65° C. Then, a resultant was left and thus a dispersion liquid in which fusion bonded particles were dispersed was obtained.

Cleaning Process:

Filtering and cleaning operations with ion exchange water were repeated for particle groups in the dispersion liquid which was obtained through the fusion-bonding process. The cleaning operation was repeated until conductivity of the liquid is equal to or smaller than 50 μS/cm.

Drying Process:

A vacuum dryer dried the particle groups which were separated by the last filtering, until the moisture content of the particle groups was equal to or less than 1.0 wt %. Thus, a first toner (15) which contained the glitter pigment was obtained.

The volume average particle size (50% D) of the first toner (15) was measured using SALD-7000 (product manufactured by Shimadzu Corporation). As a result, the volume average particle size of particle groups of the first toner (15) was 43.8 μm.

A manufacturing method of a second toner (15) which does not contain the colorant will be described below.

A binder resin, a releasing agent, and an electrification control agent which were the same as the binder resin, the releasing agent, and the electrification control agent used in the manufacturing method of the second toner (3) were respectively used.

Mixing and Melt Kneading Process:

83 parts by mass of the polyester resin, 11 parts by mass of the ester wax, and 1 part by mass of the electrification control agent were mixed by a Henschel mixer, and thus a raw material mixture (m15) was prepared. Then, the raw material mixture (m15) was melt-kneaded by a biaxial kneader of which the temperature was set to 120° C., and thereby a kneaded mixture (m15a) was obtained.

Pulverizing Process:

The kneaded mixture (m15a) was coarsely pulverized by a feather mill, and thus a coarsely pulverized product (m15b) was obtained. Thus, the coarsely pulverized product (m15b) was pulverized by a jet mill.

Classifying Process:

Then, classification was performed by a rotor type classifier, and thus a second toner (15) in which the volume average particle size of particle groups was 6.5 μm was obtained.

An image was formed of the obtained first toner (15) and the second toner (15), using the above-described image forming method X.

Table 1 represents compositions of the first toner and the second toner which are manufactured in each of the examples.

TABLE 1

| | First toner (wt %) | | | | Second toner (wt %) | | | |
|---|---|---|---|---|---|---|---|---|
| | Colorant | Binder resin | Releasing agent | Volume average particle size (μm) | Binder resin | Releasing agent | Electrification control agent | Volume average particle size (μm) |
| Example 1 | 40.0 | 56.3 | 3.7 | 70.1 | 93.8 | 6.2 | 0 | 6.0 |
| Example 2 | 37.2 | 57.0 | 5.8 | 131.2 | 89.5 | 10.5 | 0 | 5.5 |
| Example 3 | 25.2 | 64.8 | 10.0 | 273.7 | 86.3 | 12.8 | 0.9 | 7.2 |
| Example 4 | 45.9 | 45.9 | 8.2 | 11.9 | 90.3 | 8.7 | 1.0 | 5.0 |
| Example 5 | 29.0 | 58.1 | 12.9 | 226.4 | 91.4 | 7.6 | 1.0 | 6.8 |
| Example 6 | 35.3 | 52.9 | 11.8 | 9.5 | 93.2 | 5.7 | 1.1 | 5.2 |
| Example 7 | 36.1 | 54.2 | 9.7 | 45.1 | 83.0 | 16.0 | 1.0 | 8.8 |
| Example 8 | 40.0 | 60.0 | 0 | 53.8 | 83.0 | 16.0 | 1.0 | 6.6 |
| Comparative Example 1 | 37.0 | 55.6 | 7.4 | 6.2 | 83.0 | 16.0 | 1.0 | 6.0 |
| Comparative Example 2 | 37.0 | 55.6 | 7.4 | 4.0 | 90.4 | 8.5 | 1.1 | 4.5 |
| Comparative Example 3 | 34.3 | 61.2 | 4.5 | 430.6 | 74.4 | 25.6 | 0 | 7.5 |
| Comparative Example 4 | 30.6 | 61.2 | 8.2 | 274.3 | 96.0 | 3.0 | 1.0 | 5.0 |
| Comparative Example 5 | 29.8 | 59.6 | 10.6 | 60.2 | 87.6 | 11.3 | 1.1 | 10.5 |
| Comparative Example 6 | 34.2 | 55.9 | 9.9 | 36.8 | 87.5 | 11.5 | 1.0 | 5.5 |
| Comparative Example 7 | 39.4 | 54.5 | 6.1 | 43.8 | 87.4 | 11.6 | 1.0 | 6.5 |

Evaluations of the coloring properties and the fixability will be described.

In the above-described image forming methods X to Z, the toner on a surface of paper was fixed at the fixation temperature of 140° C., and thereby an image was formed.

Then, the coloring properties of the image and the fixability of the toner were respectively evaluated with the eyes.

An evaluation criterion of the coloring properties is as follows.

Evaluation Criterion of the Coloring Properties

A: a fixed image has no non-uniformity and glittering feeling.

B: a fixed image has some non-uniformity and glittering feeling.

C: a fixed image has non-uniformity and no glittering feeling.

An evaluation criterion of the fixability is as follows.

Evaluation Criterion of the Fixability

A: image peeling due to the offset or not-fixation does not occur

B: image peeling occurs due to the offset or not-fixation.

Table 2 represents evaluation results of the coloring properties and the fixability regarding the toner which was manufactured in each of Examples.

TABLE 2

| | First toner | | | | Second toner | | | Ratio (part by mass) of second toner with respect to 100 parts by mass of first toner | | Evaluation | |
|---|---|---|---|---|---|---|---|---|---|---|---|
| | Volume average particle size (μm) of colorant particle group | Long diameter (μm) | Short diameter (μm) | Aspect ratio (long diameter/short diameter) | Long diameter (μm) | Short diameter (μm) | Aspect ratio (long diameter/short diameter) | | Image forming method | Decoration properties | Fixability |
| Example 1 | 60.1 | 70.1 | 4.5 | 15.6 | 6.0 | 5.9 | 1.0 | 1.3 | Z | B | A |
| Example 2 | 120.5 | 131.2 | 5.3 | 24.8 | 5.5 | 5.0 | 1.1 | 15.0 | Z | A | A |
| Example 3 | 250.7 | 273.7 | 7.0 | 39.1 | 7.2 | 6.0 | 1.2 | 50.6 | Y | A | A |
| Example 4 | 10.1 | 11.9 | 3.4 | 3.5 | 5.0 | 4.5 | 1.1 | 25.5 | X | B | A |
| Example 5 | 200.3 | 226.4 | 6.6 | 34.3 | 6.8 | 5.3 | 1.3 | 60.4 | Y | A | A |
| Example 6 | 7.0 | 9.5 | 2.8 | 3.4 | 5.2 | 4.3 | 1.2 | 35.5 | Y | B | A |
| Example 7 | 40.3 | 45.1 | 5.5 | 8.2 | 8.8 | 7.9 | 1.1 | 1.2 | X | B | A |
| Example 8 | 50.3 | 53.8 | 4.8 | 11.2 | 6.6 | 5.7 | 1.2 | 40.6 | X | B | A |
| Comparative Example 1 | 1.5 | 6.2 | 3.0 | 2.1 | 6.0 | 4.5 | 1.3 | 65.5 | X | C | A |
| Comparative Example 2 | 3.5 | 4.0 | 2.0 | 2.0 | 4.5 | 3.5 | 1.3 | 45.8 | X | C | A |
| Comparative Example 3 | 400.2 | 430.6 | 6.5 | 66.3 | 7.5 | 7.0 | 1.1 | 33.8 | Z | A | B |
| Comparative Example 4 | 250.7 | 274.3 | 8.0 | 34.3 | 5.0 | 3.5 | 1.4 | 48.7 | Y | B | B |
| Comparative Example 5 | 55.3 | 60.2 | 5.0 | 12.0 | 10.5 | 3.2 | 3.3 | 10.2 | Y | C | B |
| Comparative Example 6 | 35.5 | 36.8 | 4.3 | 8.6 | 5.5 | 4.8 | 1.2 | 0.2 | Z | B | B |
| Comparative Example 7 | 40.1 | 43.8 | 7.8 | 5.6 | 6.5 | 6.2 | 1.1 | 116.2 | X | C | A |

In Examples 1 to 8, both of the coloring properties and the fixability had good evaluation results.

To the contrary, in Comparative Examples 1 to 7, at least one of the coloring properties and the fixability had a poor evaluation result.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. A developing device for an image forming apparatus, comprising:

a toner mixture within the developing device, the toner mixture including:

a first toner comprising first toner particles; and a second toner comprising second toner particles, wherein the first toner particles each include a plate-like colorant particle and binder resin particles on an outer surface of the plate-like colorant particle, a volume average size of the plate-like colorant particles in the first toner particles being equal to or greater than 6 μm, the second toner particles each comprise a first binder resin and a releasing agent, and do not include a colorant, and each second toner particle has an aspect ratio equal to or smaller than 3, a content ratio of the releasing agent in the second toner particles is between 4 wt % and 24 wt %, and a ratio of the second toner to the first toner in the toner composition mixture is greater than 1 wt % and equal to or less than 75 wt %.

2. The developing device according to claim 1, wherein the plate-like colorant particle is a bright colorant particle.

3. The developing device according to claim 2, wherein the bright colorant particle is an inorganic base particle covered with a metal oxide layer or a metal particle.

4. The developing device according to claim 1, wherein the volume average size of the plate-like colorant particles in first toner particles is 300 μm or less.

5. The toner developing device according to claim 1, wherein the first toner particles have an aspect ratio equal to or greater than 3.

6. The developing device according to claim 1, wherein a content ratio of the plate-like colorant particles in the first toner particles is between 10 wt % and 65 wt %.

7. The developing device according to claim 1, wherein a volume average size of the second toner particles is between 3 μm and 12 μm.

8. The developing device according to claim 1, wherein the binder resin particles on an outer surface of the plate-like colorant particle in the first toner particles are comprised of a binder resin that has a weight average molecular weight that is equal to a weight average molecular weight of the first binder resin.

9. The developing device of claim 1, wherein the toner mixture further includes a carrier component.

10. An image forming apparatus, comprising:

a developing device storing a toner composition mixture;

a photoconductive drum on which a toner image corresponding to an electrostatic latent image formed on the photoconductive drum can be formed, the toner image comprising the toner composition mixture supplied from the developing device; and a transfer roller by which the toner image from the photoconductive drum can be transferred to a transfer belt; and a fixing unit configured to fix the toner image on a sheet after transfer from the transfer belt, wherein the toner composition mixture stored in the developing device includes:

a first toner comprising first toner particles; and a second toner comprising second toner particles, wherein the first toner particles each include a plate-like colorant particle and binder resin particles on an outer surface of the plate-like colorant particle, a volume average size of the plate-like colorant particles in the plurality of first toner particles being equal to or greater than 6 μm, the second toner particles each comprise a first binder resin and a releasing agent, and do not include a colorant, and each second toner particle has an aspect ratio equal to or smaller than 3, a content ratio of the releasing agent in the second toner particles is between 4 wt % and 24 wt %, and a ratio of the second toner to the first toner in the toner composition mixture is greater than 1 wt % and equal to or less than 75 wt %.

11. The image forming apparatus according to claim 10, wherein the plate-like colorant particle is a bright colorant particle.

12. The image forming apparatus according to claim 10, wherein the volume average size of the plate-like colorant particles in the first toner particles is 300 μm or less.

13. The image forming apparatus according to claim 10, wherein the first toner particles have an aspect ratio equal to or greater than 3.

14. The image forming apparatus according to claim 10, wherein a content ratio of the plate-like colorant particles in the first toner particles is between 10 wt % and 65 wt %.

15. The image forming apparatus according to claim 10, wherein a volume average size of the second toner particles is between 3 μm and 12 μm.

16. The image forming apparatus according to claim 10, wherein the binder resin particles on an outer surface of the plate-like colorant particle in the first toner particles are comprised of a binder resin that has a weight average molecular weight that is equal to a weight average molecular weight of the first binder resin.

17. The image forming apparatus of claim 10, wherein a content ratio of the binder resin particles in the first toner particles is between 30 wt % and 85 wt %, and a content ratio of wax in the first toner particles is less than 20 wt %.

18. The image forming apparatus of claim 17, wherein a content ratio of the first binder resin in the second toner particles is between 78 wt % to 97 wt %, a content ratio of wax in the second toner particles is between 4 wt % and 24 wt %.

19. The image forming apparatus of claim 1, wherein developing device stores the toner composition mixture mixed with a carrier component.

20. An image forming process, comprising:

forming an electrostatic latent image on a photoconductive drum;

forming a toner image corresponding to the electrostatic latent image on the photoconductive drum, the toner image comprising a toner composition mixture supplied from a developing device, wherein the toner composition mixture includes:

a first toner comprising first toner particles; and a second toner comprising second toner particles, wherein the first toner particles each include a plate-like colorant particle and binder resin particles on an outer surface of the plate-like colorant particle, a volume average size of the plate-like colorant particles in the plurality of first toner particles being equal to or greater than 6 μm, the second toner particles each comprise a first binder resin and a releasing agent, and do not include a colorant, and each second toner particle has an aspect ratio equal to or smaller than 3, a content ratio of the releasing agent in the second toner particles is between 4 wt % and 24 wt %, and a ratio of the second toner to the first toner in the toner composition mixture is greater than 1 wt % and equal to or less than 75 wt %.

* * * * *